US007150511B2

(12) United States Patent
Oguri et al.

(10) Patent No.: US 7,150,511 B2
(45) Date of Patent: Dec. 19, 2006

(54) RECORDING APPARATUS AND RECIPROCATING RECORD POSITION ALIGNMENT METHOD

(75) Inventors: Hirofumi Oguri, Nagoya (JP); Tetsuya Kato, Chiryu (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 232 days.

(21) Appl. No.: 10/946,115

(22) Filed: Sep. 22, 2004

(65) Prior Publication Data

US 2005/0062785 A1 Mar. 24, 2005

(30) Foreign Application Priority Data

Sep. 22, 2003 (JP) ..... 2003-330297

(51) Int. Cl.
*B41J 29/393* (2006.01)

(52) U.S. Cl. ..... 347/19; 347/9; 347/14

(58) Field of Classification Search ..... 347/19, 347/9, 10, 14, 15, 40–41; 250/568
See application file for complete search history.

(56) References Cited

U.S. PATENT DOCUMENTS 4,449,052 A * 5/1984 Krieg ..... 250/568
6,409,301 B1 * 6/2002 Takata et al. ..... 347/19
6,431,679 B1 * 8/2002 Li et al. ..... 347/19
6,454,390 B1 9/2002 Takahashi et al. ..... 347/41

FOREIGN PATENT DOCUMENTS

JP A 2000-037937 2/2000

* cited by examiner

*Primary Examiner*—Stephen Meier
*Assistant Examiner*—Lam S. Nguyen
(74) *Attorney, Agent, or Firm*—Oliff and Berridge, PLC

(57) ABSTRACT

A recording apparatus has a bidirectional recording section, a check pattern recording section that forms check patterns different in record position of backward recording relative to forward recording when each check pattern having vertical ruled lines are recorded, a density data detection section that acquires density data of each check pattern, a density amplitude detection section that extracts partial in each partial segment from the density data of each check pattern, detects minimum and maximum values of each partial data, and detects a difference between the minimum and maximum values as a density amplitude value, an amplitude difference detection section that detects a difference between the density amplitude values of adjacent partial segments as an amplitude difference value in each check pattern, and a best pattern determination section that determines a best check pattern in which the variation amount of the density data is the smallest in each check pattern.

12 Claims, 15 Drawing Sheets

| PERTIAL DETERMINATION SEGMENT | AMPLITUDE Ai | AMPLITUDE DIFFERENCE VALUE Cj |
|---|---|---|
| T1 | A1 = 64 | C1 = 26 |
| T2 | A2 = 90 | C2 = 30 |
| T3 | A3 = 60 | C3 = 35 |
| T4 | A4 = 95 | C4 = 21 |
| T5 | A5 = 74 | C5 = 44 |
| T6 | A6 = 118 | C6 = 48 |
| T7 | A7 = 70 | |

RECORDING APPARATUS AND RECIPROCATING RECORD POSITION ALIGNMENT METHOD

BACKGROUND OF THE INVENTION

1. Field of the Invention

The present invention relates to a recoding apparatus for performing recording on a recording medium by means of bidirectional recording obtained by superposing recording based on a forward stroke of a recording head (hereinafter referred to as "forward recording") on recording based on a backward stroke of the recording head (hereinafter referred to as "backward stoke recording"), and a reciprocating record position alignment method for aligning the record position of the backward recording relative to the forward stoke recording in the recording apparatus.

2. Description of the Related Art

A recording apparatus (so-called bidirectional recording printer) for performing recording on a recording medium in such a manner that a recording head having ink jet nozzles is reciprocated by a carriage to superpose recording based on a forward stroke of the recording head and recording based on a backward stroke of the recording head on each other has been heretofore put into practical use.

In this type printer for performing bidirectional recording, there is however a problem that record position displacement (print position displacement) occurs between the forward recording and the backward recording. The record position displacement is caused by the following factors: backlash of a carriage drive mechanism at the time of forward movement and at the time of backward movement; positional displacement between the forward record position where ink jetted at the time of forward stoke recording (forward printing) is deposited on a sheet and the backward record position where ink jetted at the time of backward recording (backward printing) is deposited on the sheet; delicate difference between the forward recording speed and the backward recording speed; etc.

Therefore, various inventions have been already proposed to eliminate the aforementioned record position displacement.

For example, in JP-A-2000-037937, there has been proposed a print position alignment method and a printing apparatus in which check patterns (patches) obtained by changing the record position of backward recording relative to forward recording by a predetermined amount successively are recorded as check patterns (patches) recorded by means of bidirectional recording so that an optimum record position (optimum print position) is determined on the basis of respective density data of the check patterns (patches). More specifically, density data of each check pattern (patch) are measured at a plurality of points (e.g. 12 points) and the average of the density data is computed (calculated), so that the record position where density is the highest is selected as an optimum record position (optimum print position) on the basis of the relation between the record position condition and the average of the density data.

When the average of density data at the plurality of points (12 points) is computed (calculated), a difference between the minimum and the maximum of the density data is calculated in accordance with each check pattern (patch). When the difference is larger than a predetermined threshold, a decision is made that density unevenness occurs, so that an optimum print position is determined in the condition that the density data of the check pattern (patch) are removed.

JP-A-2000-037937 (especially, paragraph numbers [0109] to [0112]) is referred to as a related art.

In the record position alignment method according to the background art, the optimum record position is however determined on the basis of density data at a plurality of points without consideration of the measurement position of the density data in each check pattern (patch). Accordingly, there is a problem that a determination result different from a determination result based on human eye observation may be deduced.

That is, when a check pattern (patch) in which adjacent density data changes slowly is determined by human eye observation, a decision may be made that there is no displacement in record position if the amount of variation in adjacent density data is small. In this case, the check pattern may be determined to be the check pattern optimized in record position (the best check pattern). Even in such a check pattern, if the difference between density data measured at positions far from each other is large, a decision may be however made that there is density unevenness. Accordingly, the check pattern is not determined to be the best check pattern by the background art method.

When density data partially varies widely according to the influence of temporary noise or the like but there is no displacement in record position as an overall record state of the check pattern, a determination by human eye observation may make a decision that there is no displacement in record position. In this case, the check pattern may be determined to be the best check pattern. Even in such a check pattern, if the difference between density data in the noise portion and density data in the other portion is large, the background art method however makes a decision that there is density unevenness. In this case, the check pattern is not determined to be the best check pattern.

On the other hand, when a check pattern in which the difference between the maximum and minimum values of density data is not large but the amount of variation of density data at adjacent detection places is large is determined by human eye observation, a decision may be made that there is any displacement in record position. Even in such a check pattern, if the difference between the maximum and minimum values of density data is smaller than that of any other check pattern, the background art method may judge the check pattern to be the best check pattern.

As described above, when a result of determination is different from a result of determination by human eye observation, there is a problem that a resulting image recorded in a record position set on the basis of the determination result is felt to be inappropriate to human beings because of displacement in record position.

SUMMARY OF THE INVENTION

The object of the invention is to provide a recording apparatus which performs bidirectional recording and in which a result of determination close to a result of determination by human eye observation can be obtained when displacement in record position is determined for aligning the record position of backward recording relative to forward recording, and a reciprocating record position alignment method used in the recording apparatus.

The invention provides a recording apparatus having a recording section that reciprocates a recording head having a plurality of ink jet nozzles through a carriage to perform bidirectional recording in which forward record and backward record by the recording head are superposed on a recording medium; a check pattern recording section that forms a plurality of check patterns which are different in record position of backward recording relative to forward recording on the recording medium when each check pattern having a plurality of vertical ruled lines is recorded by performing the bidirectional recording with the recording section; a sensor that moves in parallel with a moving direction of the carriage, the sensor including a light-emitting section that emits light toward the recording medium, and a light-receiving section that receives light reflected from the recording medium; a density data detection section that acquires density data indicating degree of light and shade of each check pattern based on the reflected light received by the light-receiving section when the sensor is moved from one end portion to the other end portion of each check pattern; a density amplitude detection section that extracts a plurality of partial data contained in each predetermined partial determination segment from the density data acquired with respect to each of the check patterns, detects a minimum value and a maximum value of the partial data in the partial determination segment, and detects a difference between the minimum value and the maximum value of the partial data as a density amplitude value; an amplitude difference detection section that detects a difference between the density amplitude values of adjacent partial determination segments as an amplitude difference value in each check pattern; a best pattern determination section that judges the amount of variation of the density data in each check pattern based on the amplitude difference values detected by the amplitude difference detection section to determine a check pattern in which the amount of variation of the density data is the smallest in the check patterns as a best check pattern in each check pattern; and a record position setting section that sets record positions of forward recording and backward recording of a check pattern determined to be the best check pattern by the best check pattern determination section as record positions when recording is performed.

The invention also provides a reciprocating record position alignment method of aligning record position of backward recording relative to forward recording in a recording apparatus for reciprocating a recording head having a plurality of ink jet nozzles through a carriage to perform bidirectional recording in which forward record and backward record by the recording head are superposed on a recording medium, the method including: a first step of recording a plurality of check patterns which are different in record position of the backward recording relative to the forward recording when each check pattern having a plurality of vertical ruled lines is recorded by performing the bidirectional recording; a second step of applying light on a region ranging one end portion to the other end portion of each check pattern in the reciprocating direction of the recording head and receiving light reflected from the check pattern to acquire density data indicating degree of light and shade of each check pattern based on the reflected light; a third step of extracting a plurality of partial data contained in each predetermined partial determination segment from the density data acquired with respect to each check of the check patterns, detecting a minimum value and a maximum value of the partial data in the partial determination segment, and detecting a difference between the minimum value and the maximum value of the partial data as a density amplitude value; a fourth step of detecting a difference between the density amplitude values of adjacent partial determination segments as an amplitude difference value in each check pattern; a fifth step of judging the amount of variation of the density data in each check pattern based on the amplitude difference values detected by the fourth step to determine a check pattern in which the amount of variation of the density data is the smallest in the check patterns as a best check pattern in each check pattern; and a sixth step of setting the record position of backward recording relative to forward recording in a check pattern determined to be the best check pattern by the fifth step as record position when recording is performed.

In the recording apparatus and the reciprocating record position alignment method according to the invention, the best check pattern in which the difference (peak difference) between the minimum value and the maximum value of density data is the smallest is not determined on the basis of the minimum value and the maximum value of density data in each check pattern but the best check pattern in a plurality of check patterns is determined on the basis of amplitude difference values of density data.

Each amplitude difference value of density data is the difference between density amplitude values of adjacent partial determination segments. Accordingly, when the amount of variation of density data is large, the amplitude difference value exhibits a large value. When the amount of variation of density data is small, the amplitude difference value exhibits a small value. That is, the amplitude difference value of density data is a value in which the amount of variation of density data is reflected. For this reason, in a check pattern in which the amount of variation of density data is judged to be small on the basis of the amplitude difference values, there can be made a decision that there is no displacement in record position.

For example, in a check pattern in which the difference between density data measured at positions far from each other is large but density data changes slowly, the amplitude difference values are small as a whole. In this case, the amount of variation of density data can be judged to be small, so that a decision can be made that there is no displacement in record position. When the check pattern in which density data changes slowly is determined by human eye observation, a decision can be made that there is no displacement in record position. In this case, a result of determination on the basis of the amplitude difference values as to whether there is any displacement in record position or not, is close to a result of determination by human eye observation.

In a check pattern in which density data partially varies widely according to the influence of temporary noise or the like but there is no displacement in record position as a whole, a place where noise is generated exhibits a large amplitude difference value but the other place exhibits a small amplitude difference value so that the amount of variation of density data can be determined to be small. Accordingly, a decision can be made that there is no displacement in record position. When the check pattern in which density data is partially affected by noise is determined by human eye observation, a decision can be made that there is no displacement in record position. Accordingly, a result of determination on the basis of the amplitude difference values as to whether there is any displacement in record position or not, is substantially equal to a result of determination by human eye observation.

In a check pattern in which the difference between the maximum and minimum values of density data is smaller than that in any other check pattern, if the amount of variation of density data between adjacent detection places in the check pattern is large, a place where the amount of variation of density data is large exhibits a large amplitude difference value so that the amount of variation of density data can be determined to be large. Accordingly, a decision can be made that there is any displacement in record position. When the check pattern in which the amount of variation of density data between adjacent detection places is large is determined by human eye observation, a decision can be made that there is any displacement in record portion. Accordingly, a result of determination on the basis of the amplitude difference values as to whether there is any displacement in record position or not, is substantially equal to a result of determination by human eye observation.

In the background art in which the best check pattern exhibiting the smallest peak difference of density data is determined on the basis of the maximum and minimum values of density data, density data are used discrete data for determining displacement in record position without consideration of continuity of density data. On the contrary, in the invention in which a determination is made on the basis of the amplitude difference values of density data, displacement in record position can be determined while continuity of density data is considered. Accordingly, even a check pattern in which the difference (peak difference) between the maximum and minimum values of density data is large may be determined to be the check pattern if density data changes slowly as a whole.

Therefore, according to the invention, because a determination is made on the basis of the amplitude difference values of density data, a check pattern in which density data changes slowly as a whole can be determined to be the best check pattern. A result of determination close to a result of determination by human sense can be obtained.

Each partial determination segment may be set in advance so that the width of the partial determination segment is larger than the pitch of vertical ruled lines in the check pattern. Specifically, the width of each partial determination segment may be preferably set so that at least one local maximum value and at least one local minimum value in the density data waveform are included in the partial sectional section.

The partial determination segments in each check pattern may be preferably set, for example, at intervals of a partial detection pitch which is set in advance in a range of from one end portion to the other end portion of the check pattern. That is, in density data in a range of from one end portion to the other portion of each check pattern, partial determination segments are set at intervals of a partial detection pitch so that partial data contained in each partial determination segment can be extracted.

On this occasion, the partial detection pitch may be set to be equal to the width of each partial determination segment or may be set to be shorter than the width of each partial determination segment so that an overlapping portion is formed between adjacent partial determination segments.

For judgment of check patterns of the same size, when the partial detection pitch is set to be short, the number of partial determination segments can be increased so that a larger number of amplitude difference values can be extracted. For this reason, when the partial detection pitch is set to be short, the amplitude difference values can be extracted more accurately and improvement in accuracy of judgment of check patterns can be attained.

DETAILED DESCRIPTION OF THE PREFERRED EMBODIMENTS

An embodiment of the present invention will be hereinafter described with reference to the accompanying drawings.

This embodiment is directed to a multifunctional apparatus having a telephone function, etc., in addition to a printer function, a copier function, a scanner function, and a facsimile function.

Figure 1:
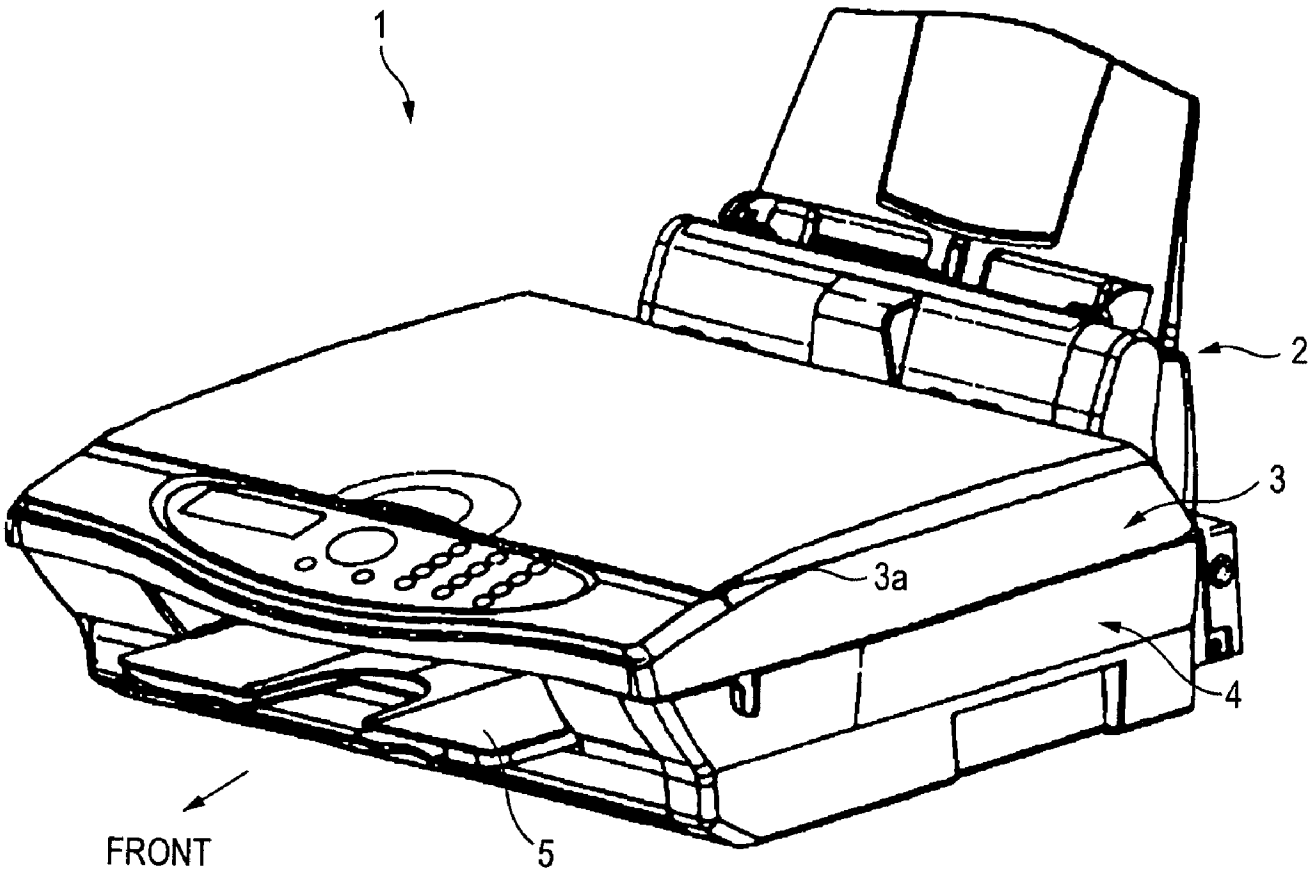
FIG. 1 is a perspective view of a multifunctional apparatus provided with an ink jet printer.

As shown in FIG. 1, a multifunctional apparatus 1 is equipped with a sheet feeder 2 on a back side thereof. A document reading device 3 for the copier function (scanner function) and the facsimile function is disposed so as to occupy a top portion of a section in front of the sheet feeder 2. An ink jet printer 4 as an implementation of the printer function is disposed so as to occupy the entire portion under the document reading device 3. A table 5 for ejection of printed sheets is disposed in front of the ink jet printer 4.

The document reading device 3 is structured as follows (not shown in FIG. 1). The document reading device 3 can be swung vertically around a horizontal axis that is located at the rear end. If a top cover 3*a* is opened upward, a user can see a document placement glass plate. An image scanning device for document reading is disposed under the glass plate. By opening the document reading device 3 upward by hand, the user can replace ink cartridges 40–43 of the ink jet printer 4 or maintain a recording mechanism section 10. That is, the ink jet printer 4 is disposed in front of the sheet feeder 2 in a manner as shown in FIG. 2.

Subsequently, the ink jet printer 4 will be described with reference to FIG. 2.

The ink jet printer 4 includes the recording mechanism section 10 for printing on a sheet (e.g., A4-sheet) supplied from the sheet feeder 2 by jetting ink droplets from a recording head 23P, a maintenance mechanism section 11 for performing maintenance processing on the recording head 23P, an ink supply section 12 for supplying inks from the ink cartridges 40–43 to the recording mechanism section 10, an air supply section 13 for supplying pressurized air to the ink cartridges 40–43, and other sections. First, the recording mechanism section 10 will be described.

Figure 2:
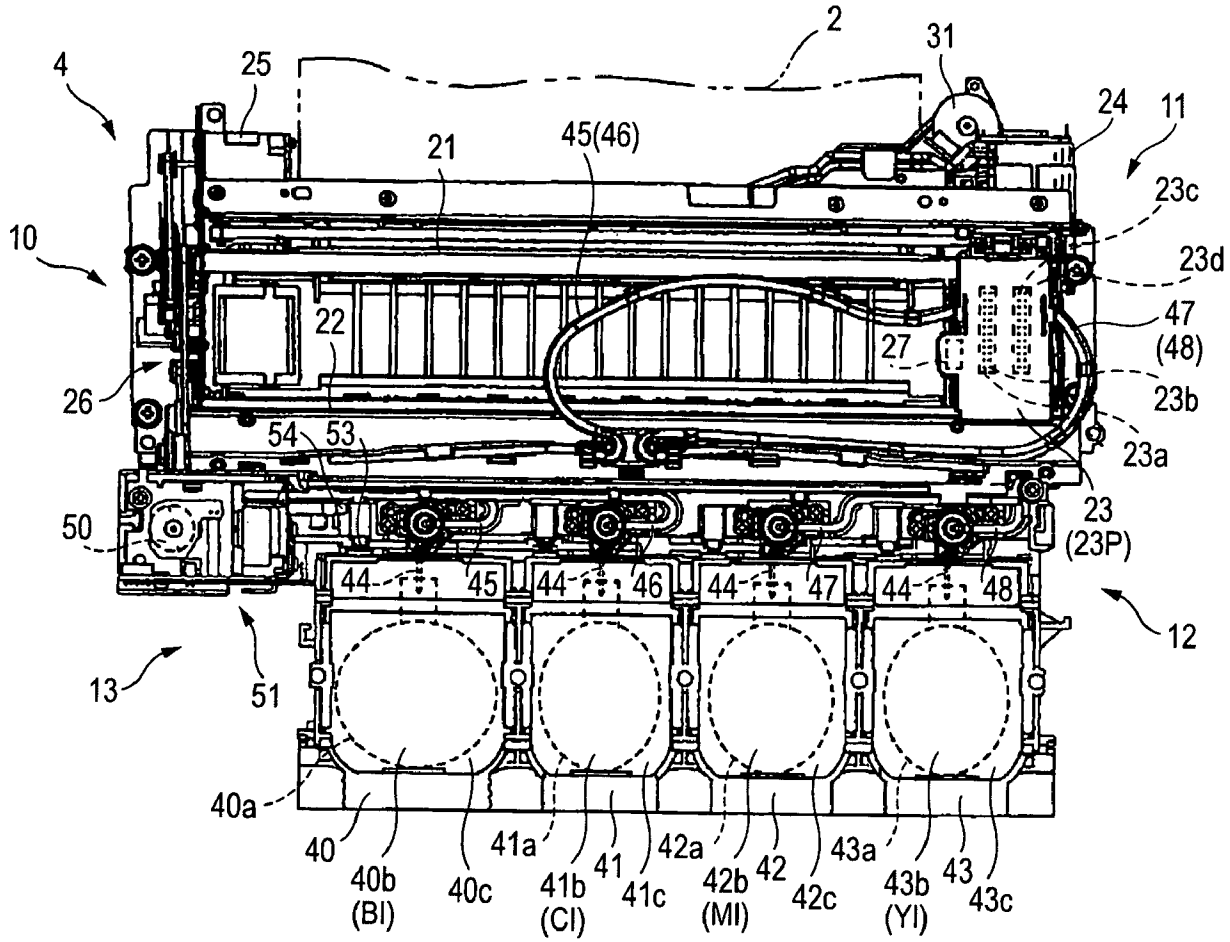
FIG. 2 is a plan view of the ink jet printer.

As shown in FIG. 2, the recording mechanism section 10 includes a carriage 23 that is housed compactly in a box-shaped print unit frame (not shown) and supported by a guide rail 22 and a guide shaft 21 that are disposed on the front side and the rear side, respectively, a carriage driving motor 24 for reciprocating the carriage 23 in the right-left direction via a wire (not shown), and other members. The carriage 23 itself also serves as the recording head 23P. A number of ink jet nozzles (hereinafter referred to as "nozzles") 23*a*–23*d* are arranged on the bottom surface of the recording head 23P in four columns in the right-left direction so as to correspond to four ink colors.

The nozzles 23*a*–23*d* are equipped with respective piezoelectric elements (not shown), and very small amounts of ink are jetted from piezoelectric-element-energized ones of the nozzles 23*a*–23*d* toward a sheet. A main transport roller, which is called "registration roller", is disposed under the guide shaft 21. The main transport roller rotates in a prescribed direction by a sheet feed motor 25 via a gear mechanism 26 to transport a sheet that is supplied from the sheet feeder 2 toward the front side (i.e., in a sheet feed direction) while moving the sheet approximately horizontally right under the recording head 23P, and to eject the sheet to the ejection table 5. An optical medium sensor 27 (which functions as "sensor") is attached downward to the left end portion of the carriage 23.

The medium sensor 27 is equipped with a light-emitting section 27*a* for emitting light toward a sheet below and a light-receiving section 27*b* for receiving light reflected from the sheet. By using the medium sensor 27, the front end and the rear end and the width of a sheet being fed can be detected. Further, when the carriage 23 is moved in the right-left direction after printing, a printed image is scanned in line form, whereby a density profile of the image can be read as analog data.

Subsequently, the maintenance mechanism section 11 will be described briefly. A thin-plate-shaped rubber wiper blade and rubber head caps (both not shown) are disposed upward under the recording head 23P as shown in FIG. 2. When a maintenance motor 31 rotates in a normal direction, the wiper blade moves upward and downward via a blade elevation mechanism (not shown). When the maintenance motor 31 rotates in a reverse direction, the head caps move upward and downward via a cap elevation mechanism (not shown).

Subsequently, the ink supply section 12 will be described.

A black ink cartridge 40, a cyan ink cartridge 41, a magenta ink cartridge 42, and a yellow ink cartridge 43 are arranged in this order from the left side in front of the ink supply section 12. Flexible film members 40*a*–43*a*, which are stretched inside the cartridge cases of the ink cartridges 40–43 so as to cover most of their entire areas, respectively, partition the cartridge cases into bottom ink accommodation rooms 40*b*–43*b* and top air rooms 40*c*–43*c*, respectively.

A black ink BI, a cyan ink CI, a magenta ink MI, and a yellow ink YI are accommodated in the ink accommodation rooms 40*b*–43*b* of the black ink cartridge 40, the cyan ink cartridge 41, the magenta ink cartridge 42, and the yellow ink cartridge 43, respectively. Ink needles 44 are disposed in the rear of the respective ink cartridges 40–43 so as to project front side. The proximal portions of the ink needles 44 are connected to the recording head 23P via dedicated ink supply tubes 45–48, respectively.

When the ink cartridges 40–43 are mounted at their prescribed mounting positions, the tip portions of the ink needles 44 penetrate through the rear end portions of the film members 40*a*–43*a* and reach the ink accommodation rooms 40*b*–43*b*, respectively, whereby the inks BI, CI, MI, and YI in the ink accommodation rooms 40*b*–43*b* are supplied to the recording head 23P via the dedicated ink supply tubes 45–48, respectively. The recording head 23P is positioned higher than the ink cartridges 40–43 so that a prescribed head difference (e.g., 5 to 6 cm) is generated between the recording head and the ink cartridges.

Therefore, the nozzles 23*a*–23*d* of the recording head 23P are filled with inks BI, CI, MI, and YI supplied and a negative pressure corresponding to the head difference develops there, whereby clear meniscuses are formed at the tips of the nozzles 23*a*–23*d* so as to be curved inward.

Next, the air supply section 13 will be described.

As shown in FIG. 2, a pump motor 50 is disposed on the left of the mounting portion for the black ink cartridge 40 and an air pump 51 to be driven by the pump motor 50 is disposed immediately on the right of the pump motor 50. Pressurized air generated by the air pump 51 is supplied to the air rooms 40*c*–43*c* of the ink cartridges 40–43 via an air supply pipe 52 and pressure contact pads 53 that are urged elastically, respectively. In an ordinary state, atmospheric pressure acts on the air rooms 40*c*–43*c* via an orifice 54 that is provided at a halfway position of the air supply tube 52.

When pressurized air having a pressure higher than the negative pressure corresponding to the head difference is generated by the air pump 51, the pressurized air acts on all the ink accommodation rooms 40*b*–43*b* because the orifice 54 is set so as to supply the pressurized air to all the air rooms 40*c*–43*c* of the ink cartridges 40–43 via the air supply tube 52. The pressurized air also acts on the inks BI, CI, MI, and YI in the nozzles 23*a*–23*d*, whereby their surface shapes in the nozzles 23*a*–23*d* are changed from the meniscus shape (i.e., concave shape) to a convex shape.

Figure 3:
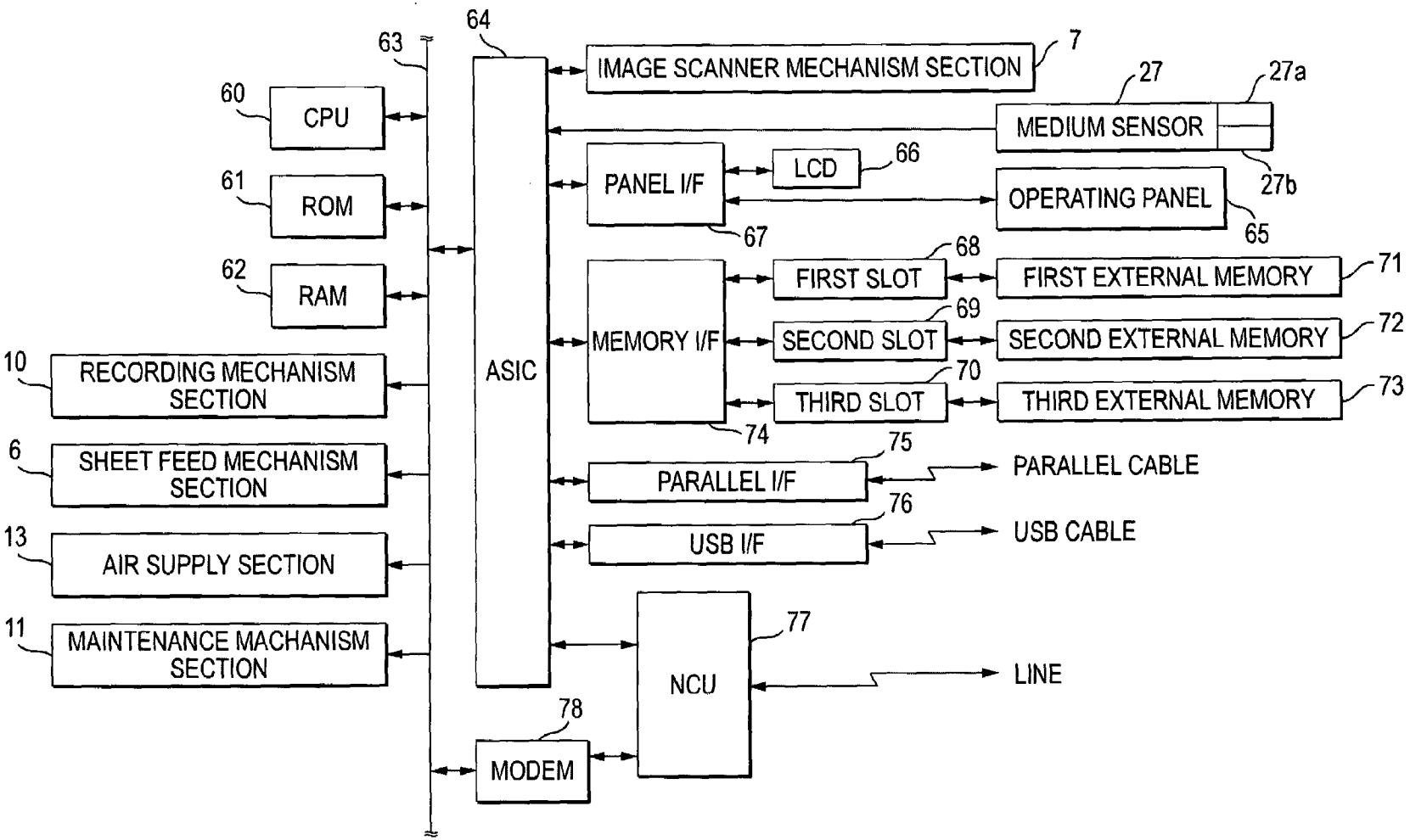
FIG. 3 is a block diagram of a control system in the multifunctional apparatus.

Next, a control system of the above-configured multifunctional apparatus 1 will be described with reference to a block diagram of FIG. 3.

The basic configuration is such that a CPU 60, a ROM 61, and a RAM 62 that constitute a control section are connected to each other via a bus 63 such as a data bus. The above-described recording mechanism section 10, sheet feed mechanism 6, air supply section 13, and maintenance mechanism section 11, an input/output ASIC (application-specific integrated circuit) 64 consisting of hard logic circuits, and other sections are also connected to the bus 63. The CPU 60, the ROM 61, the RAM 62, the ASIC 64, I/Fs 67 and 74, etc., constitute a controller.

An image scanner mechanism section 7, the medium sensor 27, a panel I/F 67 for an operating panel 65 and a liquid crystal display (LCD) 66, a memory I/F 74 for a plurality of (first to third) slots 68–70, a parallel I/F 75 that is connected to a parallel cable that is connected to an external printer or the like, a USB I/F 76 that is connected to a USB cable that is connected to one of various kinds external apparatuses, and an NCU (network control unit) 77 that is connected to an external telephone lines are connected to the ASIC 64. Part of the NCU 77 is also connected to the bus 63 via a modem 78.

A first external memory 71, a second external memory 72, and a third external memory 73 are connected to the first slot 68, the second slot 69, and the third slot 70, respectively. Each of the first to third external memories 71–73 is CompactFlash (registered trademark), SmartMedia (registered trademark), a memory stick (registered trademark), or the like. Various control programs for implementing the above-described printer function, copier function, scanner function, facsimile function, and telephone function are stored in the ROM 61 in advance. The RAM 62 incorporates various memories such as an information storage memory for storing various data that are input via the parallel cable or the USB cable and an information transmission memory to be used for transmitting data outside via the parallel cable or the USB cable.

Next, a control program for a go/return printing position adjustment control that is stored in the ROM 61 will be described with reference to flowcharts of FIGS. 4 and 5. Go-printing vertical ruled line data in which vertical ruled lines are arranged with a prescribed small pitch for go-printing (see FIG. 7A) and return-printing vertical ruled line data in which vertical ruled lines are arranged with a prescribed small pitch for return-printing (see FIG. 7B) are stored in the ROM 61. Further, as shown in the following table 1, a printing position shift amount (in terms of the number of dots) in return-printing is stored in the ROM 61 for each of seven kinds of test patterns.

TABLE 1

| Check Pattern Number | Displacement (number of dots) |
|---|---|
| 0 | −12 |
| 1 | −8 |
| 2 | −4 |
| 3 | 0 |
| 4 | 4 |
| 5 | 8 |
| 6 | 12 |

Figure 7A:
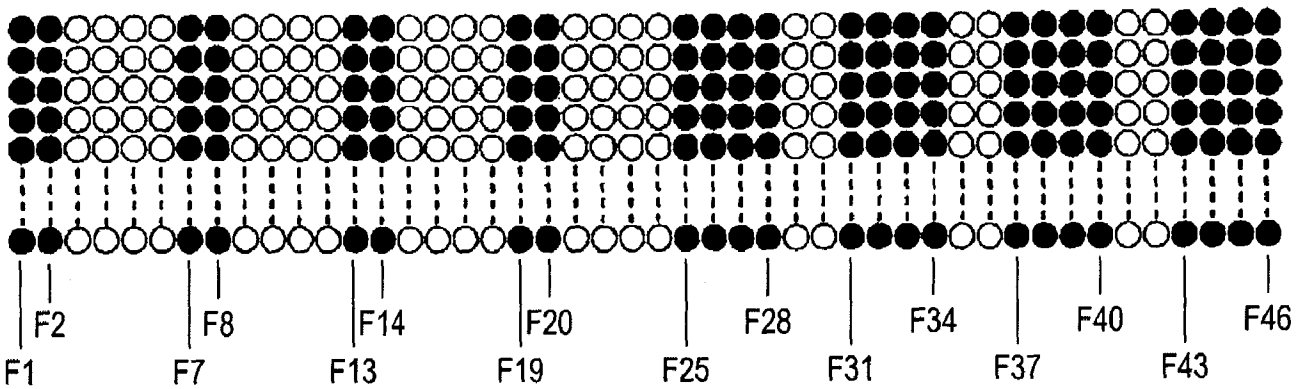
FIG. 7A is an explanatory view showing forward recording vertical ruled line data in which vertical ruled lines are arranged at intervals of a predetermined small pitch for forward recording.
Figure 7B:
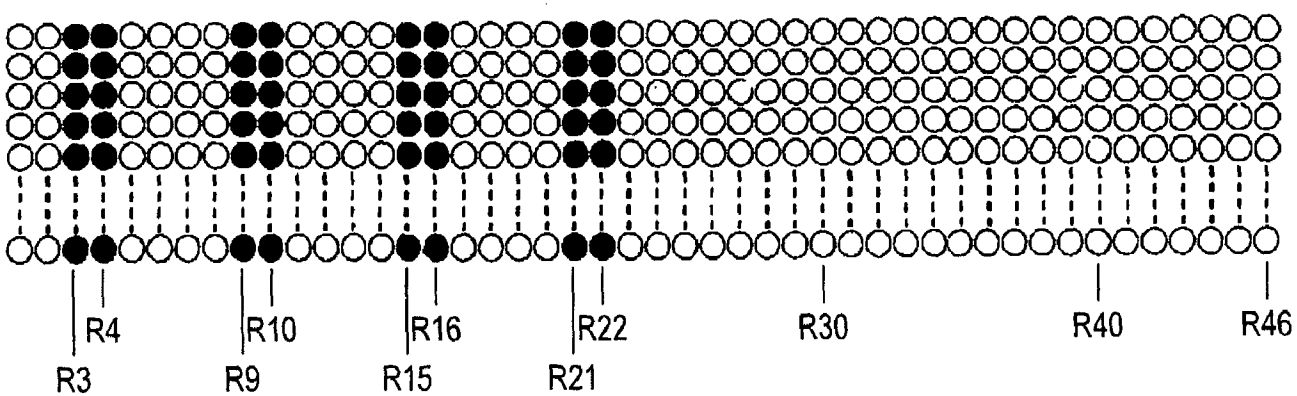
FIG. 7B is an explanatory view showing backward recording vertical ruled line data in which vertical ruled lines are arranged at intervals of a predetermined small pitch for backward recording.

For example, as shown in FIG. 7A, the go-printing vertical ruled line data are such that F1 and F2, F7 and F8, F13 and F14, and F19 and F20 cause printing of four vertical ruled lines each being a 2-dot-width line and F25–F28, F31–D34, F37–F40, and F43–F46 cause printing of four vertical ruled lines each being a 4-dot-width line. For example, as shown in FIG. 7B, the return-printing vertical ruled line data are such that R3 and R4, R9 and R10, R15 and R16, and R21 and R22 cause printing of two vertical ruled lines each being a 2-dot-width line in addition to the vertical ruled lines printed by F1 and F2, F7 and F8, F13 and F14, and F19 and F20.

This control is executed when an inspector manipulates a go/return printing position correction key that is provided on the operating panel 65 of the ink jet printer 1 in a print test that is conducted in shipping a product in a manufacturer of the ink jet printer 1. The go/return printing position correction key may be a combination of existing keys. Upon a start of the control, a message "Set sheets." is displayed on the liquid crystal display 66 (S100). The inspector sets sheets for a test in the sheet feeder 2. When a test pattern printing key is manipulated (S110: YES), a 600-mode flag DF for setting a 600-dpi mode as a print resolution is set (S120).

If supply of a sheet has been detected by the medium sensor 27 (S130: YES), a test pattern number N is set to an initial value "0" (S140) and a shift amount of the test pattern number "0" is read (S150). Then, a test pattern is printed in such a manner that go-printing is conducted on the basis of the go-printing vertical ruled line data and return-printing is conducted on the same line (i.e., without feeding the sheet) on the basis of the return-printing vertical ruled line data and the shift amount (S160). Then, a vertical ruled line image of the printed test pattern is read (S180) by scanning it by moving the medium sensor 27 linearly (S170).

On this occasion, the check pattern can be scanned immediately after recorded because recording of the check pattern is executed by only nozzles (of the recording head 23P) located on the upstream side of the medium sensor 27 in the sheet conveyance direction. Accordingly, labor can be dispensed with, compared with the case where check patterns are read from a sheet by a reader (such as a scanner) provided separately after all the check patterns are recorded on the sheet.

In this case, image data, that is, gradation data representing a density profile, that have been scanned-in by the medium sensor 27 are such as to have small values in black portions (vertical ruled lines) and large values in unprinted, white portions (i.e., portions other than the vertical ruled lines). Then, the gradation data scanned-in by the medium sensor 27, that is, analog data, are converted into digital data (what is called AD values). The digital data are stored in an AD memory of the RAM 62 (S190). Then, the sheet is fed by a prescribed length (S200).

Figure 8:
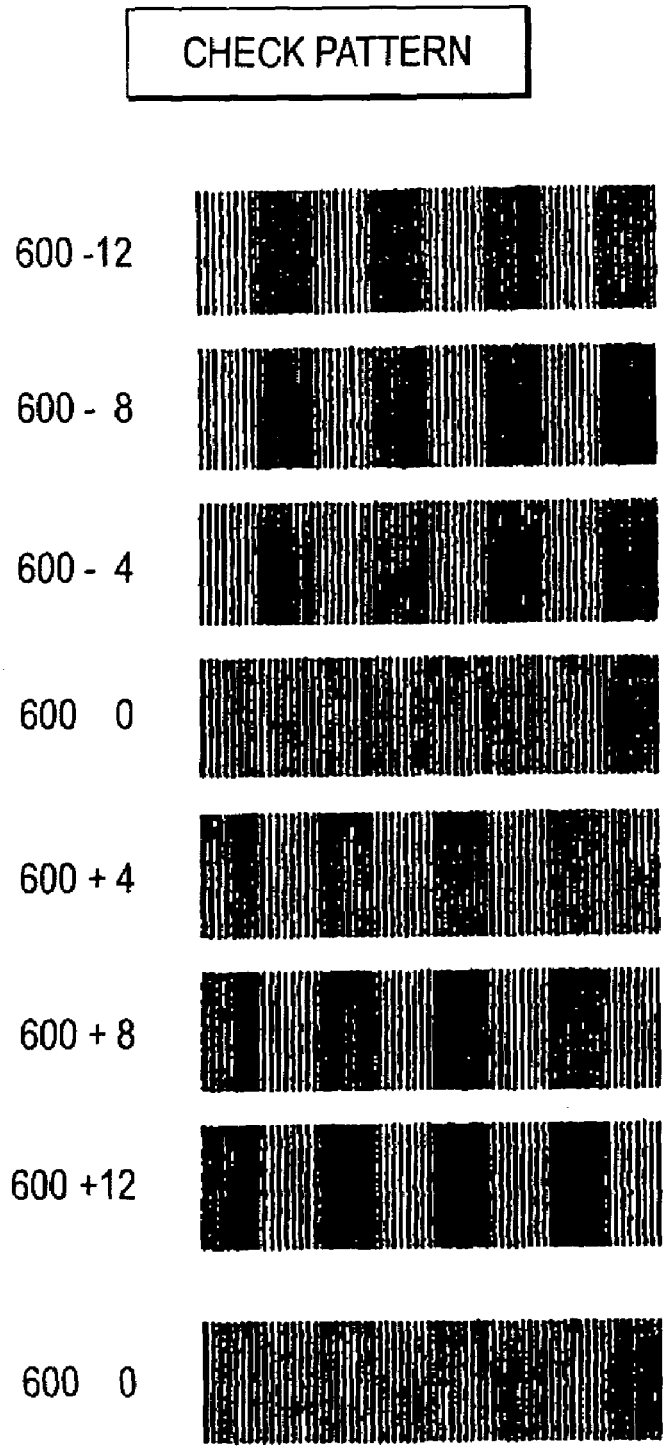
FIG. 8 is an explanatory view showing a state in which the best check pattern in resolution of 600 dpi is recorded in addition to seven check patterns different in the amount of displacement.

Then, if the test pattern number N is not equal to the maximum number (in this embodiment, 6) (S210: NO), N is incremented by "1" (S220) and steps S15–S22 are executed again. For example, as shown in FIG. 8, seven kinds of test patterns are printed at a resolution of 600 dpi in such a manner that the printing positions are shifted by −12 dots, −8 dots, −4 dots, 0 dot, +4 dots, +8 dots, and +12 dots, respectively, in the return printing.

Figure 9:
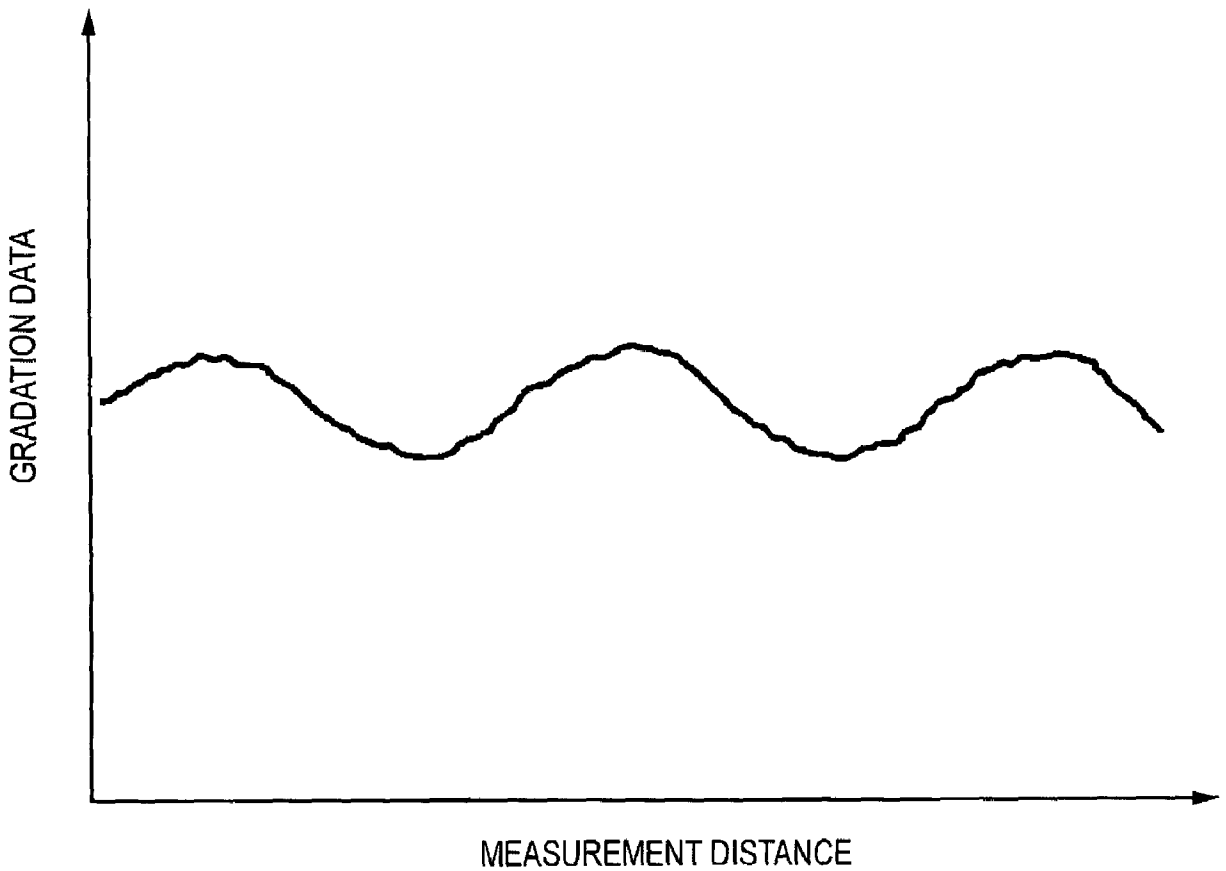
FIG. 9 is an explanatory graph showing gradation data (analog data) in a check pattern exhibiting displacement of "−12 dots"
Figure 10:
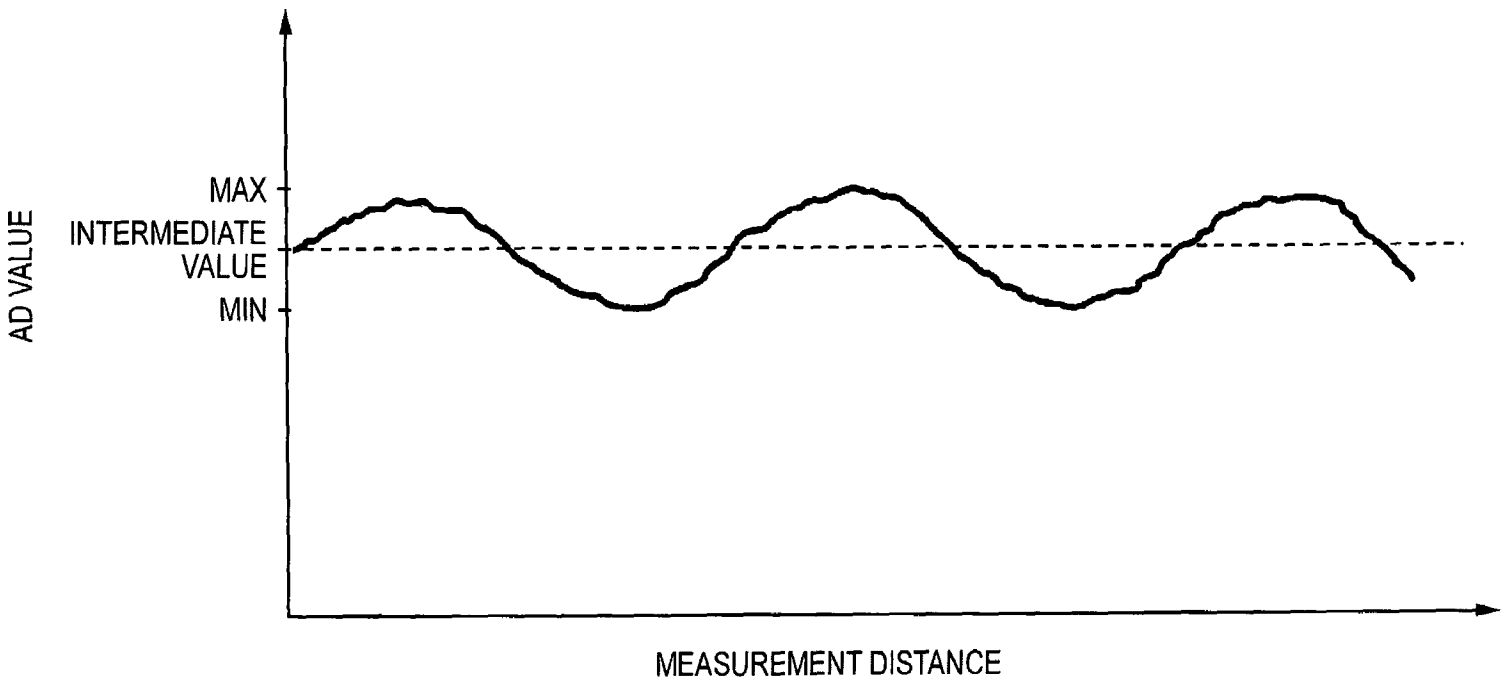
FIG. 10 is an explanatory graph showing digital data (AD values) in the case where gradation data (analog data) in a check pattern exhibiting displacement of "−12 dots" are converted into digital numerical values.

For example, in the case of the test pattern whose shift amount is equal to −12 dots, as shown in FIG. 9, gradation data (analog data) are measured at measurement distances that are separated from each other by a very small length. As shown in FIG. 10, digital data (AD values) of 256 gradation levels are obtained by converting the gradation data into digital numerical values and stored in the AD memory of the RAM 62. When the scanned-in image is white, the gradation data in FIG. 9 becomes 255. When the scanned-in image is black, the gradation data in FIG. 9 becomes 0.

Figure 11:
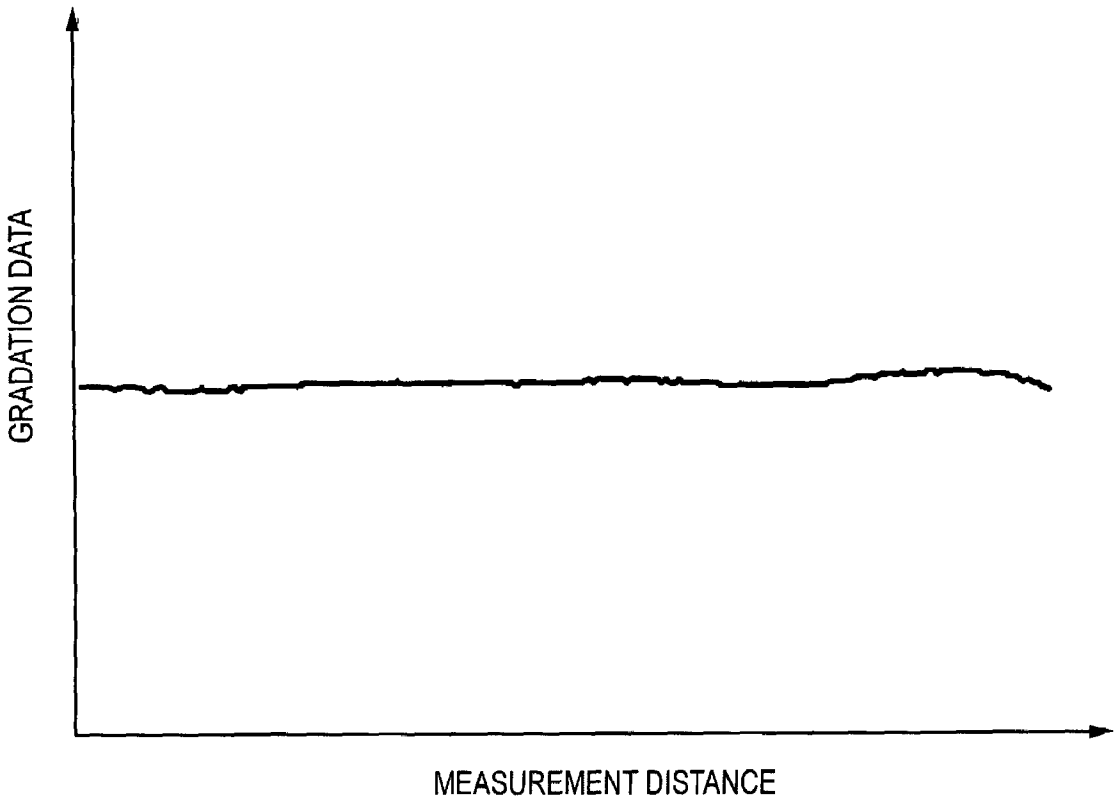
FIG. 11 is an explanatory graph showing gradation data (analog data) in a check pattern exhibiting displacement of "0 dots"
Figure 12:
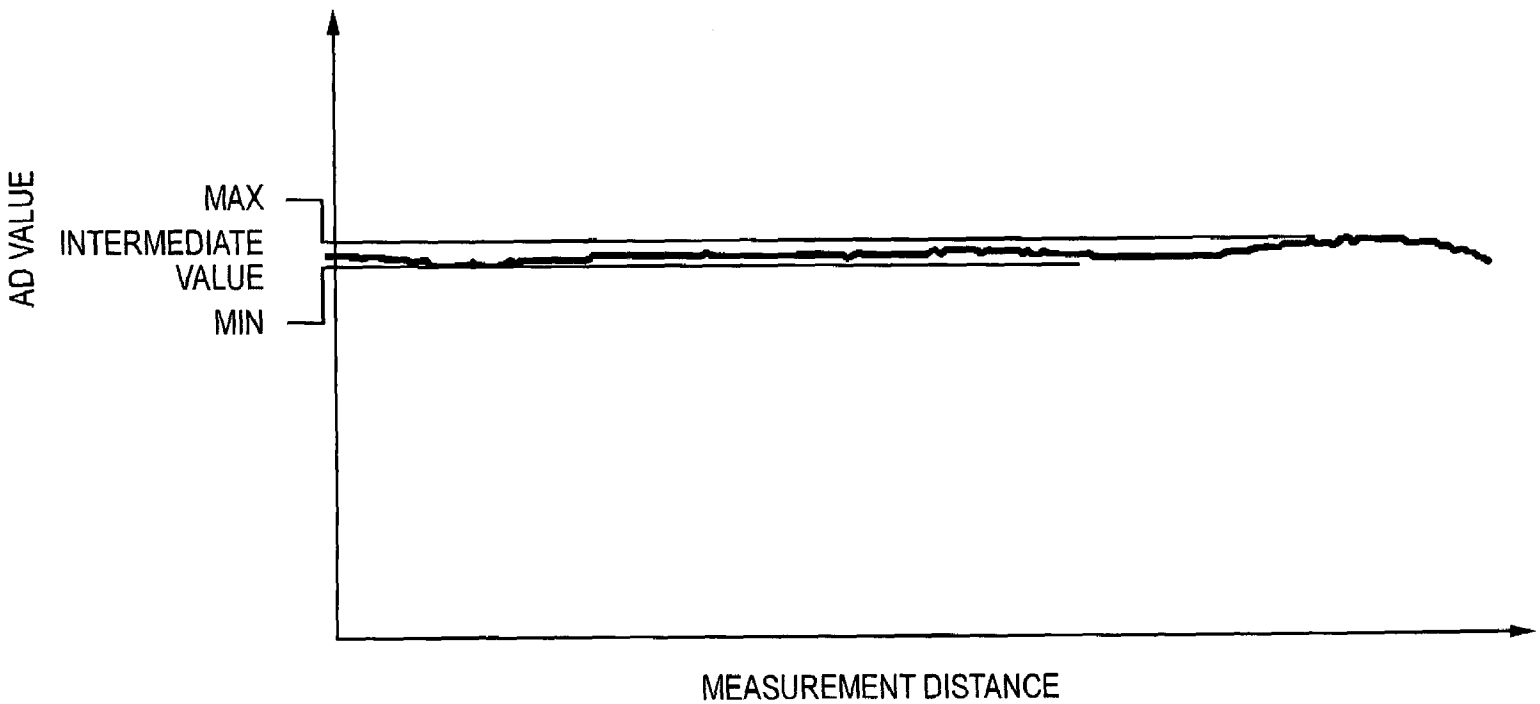
FIG. 12 is an explanatory graph showing digital data (AD values) in the case where gradation data (analog data) in a check pattern exhibiting displacement of "0 dots" are converted into digital numerical values.

In the case of the test pattern whose shift amount is equal to 0 dot, as shown in FIG. 11, gradation data (analog data) are measured at measurement distances that are separated from each other by the very small length. As shown in FIG. 12, AD values of 256 gradation levels are obtained by converting the gradation data into digital numerical values and stored in the AD memory of the RAM 62.

If the test pattern number N is equal to the maximum value "6" (S21: YES), which means that all test patterns have been printed, a computation process for determining a test pattern number N corresponding to the best pattern among the seven test pattern numbers is executed (S230; see FIG. 5.).

Figure 6:
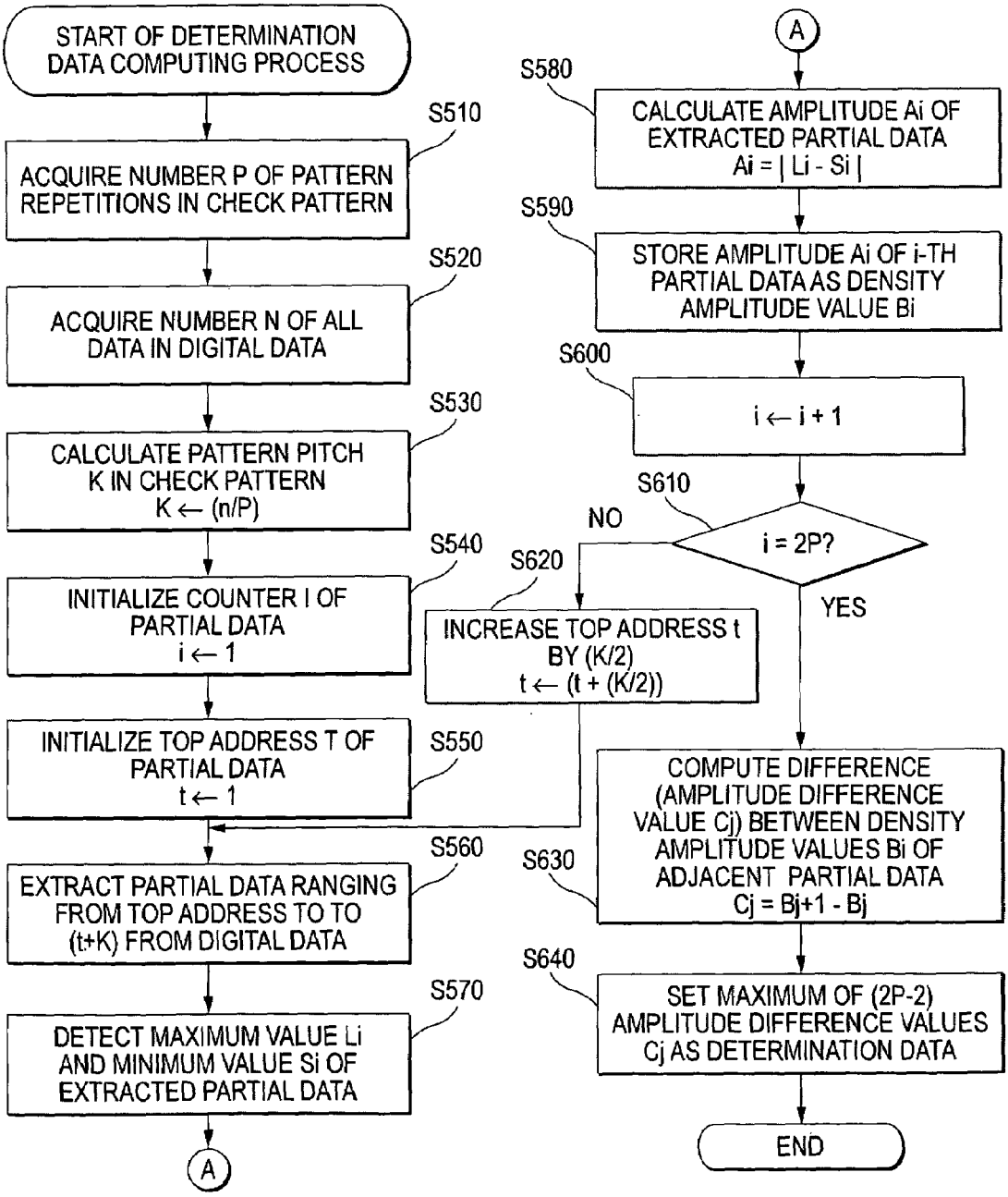
FIG. 6 is a flow chart showing the contents of an arithmetic process for detecting determination data.

When the arithmetic process for detecting the best check pattern number N starts, a counter m is first initialized so as to be set at "0" (S310). Then, an arithmetic process for detecting determination data for determining the best check pattern number N (hereinafter also referred to as "determination data computing process") (see FIG. 6) is executed on the basis of the AD values (digital data) of the check pattern (S320).

When the arithmetic process for detecting determination data starts, the number P of pattern repetitions in the check pattern of the check pattern number N is first acquired (S510). The number P of pattern repetitions is the number of repetitions of the check pattern recorded by superposing the forward stoke recoding vertical ruled line data shown in FIG. 7A and the backward stoke recoding vertical ruled line data shown in FIG. 7B on each other. The number P of pattern repetitions is stored in the ROM 61 in advance.

Then, the number n of all data (dots) in the AD values (digital data) of the check pattern is acquired (S520). The number n of all data is divided by the number P of pattern repetitions to calculate a pattern pitch K in the AD values (digital data) (S530).

Then, a counter "i" of partial data is initialized so as to be set at "1" (S540). The top address "t" of partial data is initialized so as to be set at "1" (S550).

Then, partial data ranging from the top address "t" to an address obtained by adding the pattern pitch K to the top address "t" are extracted from the AD values (digital data) (S560). The maximum value $L_i$ and the minimum value $S_i$ of the extracted partial data are detected (S570). Then, the absolute value of the difference between the detected maximum value $L_i$ and the detected minimum value $S_i$ is calculated as the amplitude $A_i$ of the partial data (S580). The calculated amplitude $A_i$ of the i-th partial data is stored as a density amplitude value $B_i$ in the RAM 62 (S590).

Then, the counter "i" is increased by one (S600) When the counter "i" is not equal to 2 P (in other words, when the counter "i" is not equal to a value twice as large as the number P of pattern repetitions) (S610: NO), the top address "t" of partial data is increased by a partial detection pitch (K/2) (S620) and the current position of the routine goes back to S560. While the counter "i" is not equal to 2P (S610: NO), the steps S560 to S620 are repeated.

By the repetition of the steps S560 to S620, partial data contained in partial determination segments (each having a width of the pattern pitch K) arranged at intervals of the partial detection pitch (K/2) are extracted from AD values (digital data) in the range of from one end portion to the other end portion of the check pattern in a plurality of installments (in this embodiment, (2P−1) installments), so that the difference between the minimum value $S_i$ and the maximum value $L_i$ in partial data in each partial determination segment can be detected as a density amplitude value $B_i$.

When the counter "i" is equal to 2P (S610: YES), the difference between density amplitude values $B_i$ of adjacent partial data in the plurality of partial data is calculated and detected as an amplitude difference value $C_j$ ($=B_j+1-B_j$) (S630). Because the number of density amplitude values $B_i$ detected is (2 P−1), the number of amplitude difference values $C_j$ detected is (2P−2).

Then, the maximum (maximum amplitude difference) of the (2P−2) amplitude difference values $C_j$ is detected and set as determination data for the check pattern designated by the counter m (S640).

When the determination data computing process is completed by termination of the step 640, the current position of the routine goes back to the best check pattern number N computing process. When the counter m is not equal to the maximum check pattern number (MAX), that is, when the counter m is not equal to the maximum number "6" in this embodiment (S330: NO), the counter m is increased by one (S340) and the steps S320 to S340 are repeated.

By the repetition of the steps S320 to S340, (2P−2) amplitude difference values $C_j$ are detected in each of all the check patterns (in this embodiment, seven check patterns), so that the maximum (maximum amplitude difference) of the (2P−2) amplitude difference values $C_j$ is set as determination data for each check pattern.

The determination data D0 to D6 set in the aforementioned manner are stored in the determination data memory area of the RAM 62 as shown in the following table 2.

TABLE 2

| Check Pattern Number | Determination Data |
|---|---|
| 0 | D0 |
| 1 | D1 |
| 2 | D2 |
| 3 | D3 |
| 4 | D4 |
| 5 | D5 |
| 6 | D6 |

Then, all the check patterns are compared with one another on the basis of the determination data Dx ($0 \leqq x \leqq 6$) so that the check pattern in which the determination data Dx can be minimized is detected from all the check patterns and determined to be the best (S350).

In this embodiment, the check pattern of the check pattern number N=3 having the displacement "0" in which the determination data Dx provided as the maximum (maximum amplitude difference) of amplitude difference values $C_j$ detected from AD values (digital data) is minimized because variation in gradation data (analog data) is small is determined to be the best of all the check patterns.

When the best check pattern number N computing process is completed by termination of the step S350, the current position of the routine goes back to the reciprocating record position automatic alignment control process. A determination is made as to whether the 600 dpi mode flag (600MF) is "1" or not (S240). When the 600 dpi mode flag (600MF) is "1" (S240: YES), the best check pattern number N (=3) in resolution of 600 dpi is stored in the RAM 62 and the amount of displacement in the check pattern number N determined to be the best is set as a record position necessary for recording with resolution of 600 dpi (S250).

Then, the number of displacement dots corresponding to the best check pattern number N (=3) and vertical ruled lines based on the number of displacement dots are recorded (S260). In this embodiment, as shown in FIG. 8, the number "0" of displacement dots corresponding to the best check pattern number "3" in resolution of 600 dpi and a check pattern based on the number "0" of displacement dots are recorded on the sheet again in addition to the seven check patterns different in the amount of displacement.

Then, the 600 dpi mode flag (600 MF) is reset, that is, cleared up to "0" (S270).

This embodiment is configured so that either 600 dpi mode or 1200 dpi mode can be selected as the resolution mode. Accordingly, when the 600 dpi mode flag (600 MF) is reset, the 1200 dpi mode is set.

When the 1200 dpi mode is set by resetting of the 600 dpi mode flag (600MF) in the step S270, the steps S150 to S220 are repeated on the basis of the resolution of 1200 dpi in the same manner as described above in the 600 dpi mode. That is, seven check patterns with resolution of 1200 dpi are recorded (see FIG. 13) on the basis of the forward recording and backward recording vertical ruled line data shown in FIGS. 7A and 7B (S150 to S220).

When three or more resolution modes are provided, configuration may be made so that flags of the number (smaller by one than the number of resolution modes) are provided.

Then, a plurality of amplitude difference values $C_j$ are detected from AD values (digital data) in each check pattern. The maximum (maximum amplitude difference) of the detected amplitude difference values $C_j$ is set as determination data Dx for each check pattern. The check pattern in which the determination data Dx is minimized is determined to be the best of all the check patterns (S230).

Figure 13:
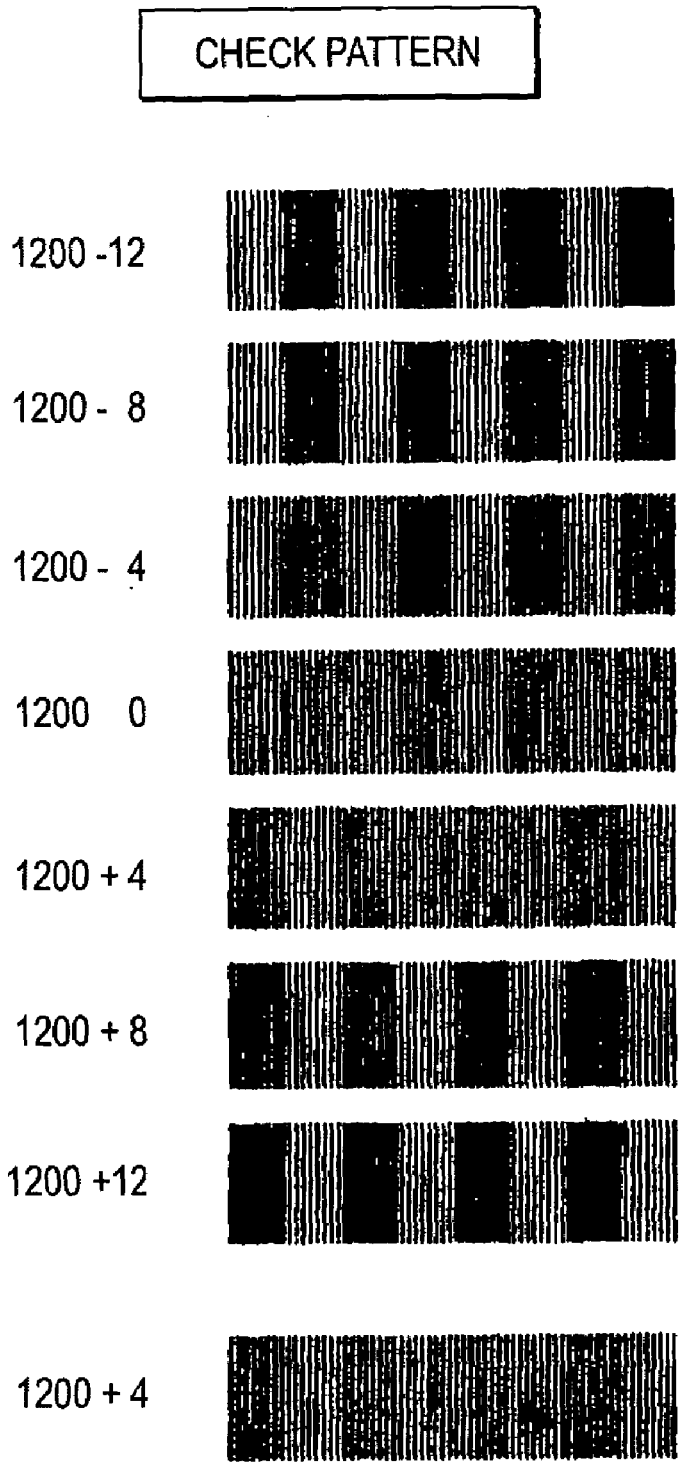
FIG. 13 is an explanatory view showing a state in which the best check pattern in resolution of 1200 dpi is recorded in addition to seven check patterns different in the amount of displacement.

In the 1200 dpi mode in this embodiment, the check pattern of the check pattern number N=4 with the displacement amount "+4" in which the determination data Dx provided as the maximum (maximum amplitude difference) of the amplitude difference values $C_j$ detected from AD values (digital data) is minimized because variation in gradation data (analog data) is small is determined to be the best of the seven check patterns shown in FIG. 13.

Then, when a result of the determination in S240 is "NO" (S240: NO), the best check pattern number N (=4) in resolution of 1200 dpi is stored in the RAM 62 and the amount of displacement in the check pattern number N determined to be the best is set as a record position necessary for recording with resolution of 1200 dpi (S280). Then, the number "+4" of displacement dots in the check pattern number N determined to be the best and a check pattern based on the number "+4" of displacement dots are recorded (see FIG. 13) (S290).

As described above, check patterns obtained in such a manner that the number of displacement dots of backward recording relative to forward recording is switched to a plurality stages are recorded. The recorded check patterns are read continuously by linear scanning due to the medium sensor 27 and analyzed. Accordingly, any one of the check patterns can be selected as the best check pattern automatically.

Moreover, because the selected best check pattern and the number of displacement dots for the best check pattern are recorded on the sheet again, the checker can judge by eye observation whether the recorded check pattern, that is, the check pattern recognized as the optimum check pattern based on recording control is truly the best or not.

As described above, in this embodiment, the best check pattern in which variation in AD value is the smallest is not determined on the basis of the minimum and maximum values of AD values (digital data) in each check pattern but the best of the check patterns is determined on the basis of the difference (amplitude difference value $C_j$) between density amplitude values of partial determination segments among AD values (density data).

Because the amplitude difference values Cj of AD values exhibit values in which variation in AD value is reflected, the check pattern in which variation in AD value can be determined to be small on the basis of the amplitude difference values $C_j$ can be determined to be free from displacement in record position.

Figure 14:
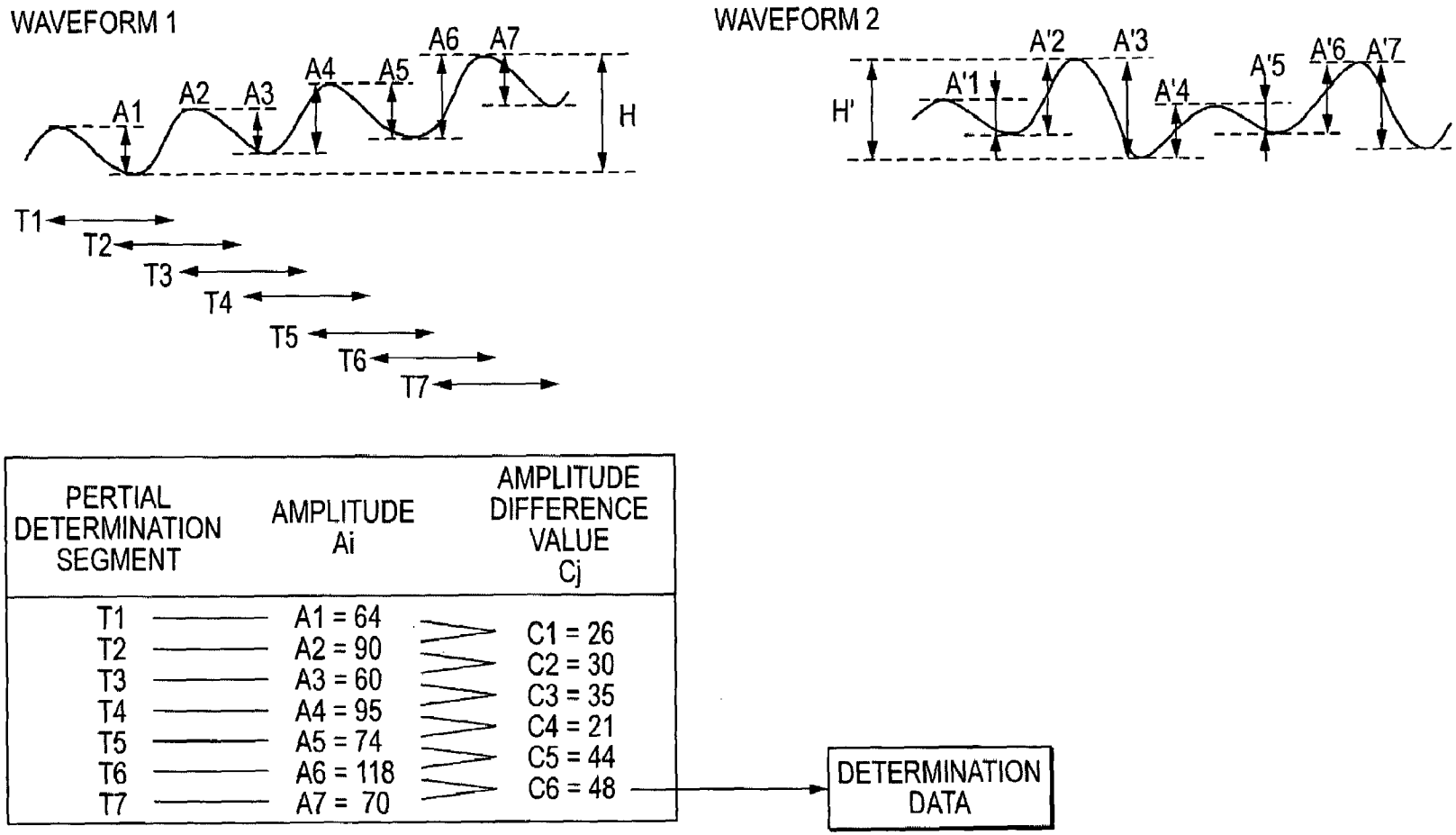
FIG. 14 is an explanatory view showing a density data waveform (waveform 1) of a check pattern in which the difference H is large but density data changes slowly, and a density data waveform (waveform 2) of a check pattern in which the difference H' is smaller than the difference H in the waveform 1 but density data changes irregularly.

FIG. 14 shows a density data waveform (waveform 1) in a check pattern in which the difference H between the maximum and minimum values of density data (AD values) on the whole of the waveform is large but the density data changes slowly, and a density data waveform (waveform 2) in a check pattern in which the difference H' between the maximum and minimum values is smaller than the difference H in the waveform 1 but the density data changes irregularly.

In FIG. 14, the setting positions of partial determination segments T1 to T7 in the waveform 1 are also shown below the waveform 1. FIG. 14 further shows a table on which numerical examples of amplitude $A_i$ (density amplitude value $B_i$) and amplitude difference value $C_j$ in the partial determination segments T1 to T7 are described.

The maximum of six amplitude difference values $C_j$ in this table is the sixth amplitude difference value C6 (=48). The sixth amplitude difference value C6 is set as determination data.

In this embodiment, AD values (digital data) of the waveform are stored as numerical data of 256 gradations in the memory. The data format of the AD values (digital data) is not limited to numerical data of 256 gradations. When, for example, high resolution is required, the AD values may be stored as numerical data of larger gradations (e.g. numerical data of 1024 gradations).

When the waveforms 1 and 2 in FIG. 14 are determined by human eye observation, results of the determination are as follows. When the waveform 1 is determined by human eye observation, record irregularity is so insensible that a decision is made that there is no displacement in record position because density data changes slowly. On the other hand, when the waveform 2 is determined by human eye observation, record irregularity is so sensible that a decision is made that there is any displacement in record position because density data changes irregularly.

When the waveforms 1 and 2 are determined by the multifunctional apparatus 1 according to this embodiment as to whether there is any displacement in record position or not, results of the determination are as follows. In the waveform 1, the amplitude difference values $C_j$ are small as a whole, so that a small value is set in the determination data Dx. On the other hand, in the waveform 2, the amplitude difference values $C_j$ are large, so that a large value is set in the determination data Dx. Accordingly, in the waveform 2 in which the determination data is large, variation in AD value is so wide that a decision is made that there is any displacement in record position. In the waveform 1 in which the determination data is small, variation in AD value is so narrow that a decision is made that there is no displacement in record position.

When the determination data of the waveform 1 is the smallest in all check patterns, the check pattern of the waveform 1 is determined to be the best check pattern.

In the background art determination method in which the best check pattern in which the difference (peak difference value) between the maximum and minimum values of density data is minimized is determined on the basis of the maximum and minimum values of AD values (density data), displacement in record position is determined on the basis of discrete density data without consideration of continuity of density data.

On the contrary, in this embodiment in which the best check pattern is determined on the basis of amplitude difference values $C_j$ of density data, displacement in record position can be determined while continuity of density data is considered. Accordingly, even in the case where the check pattern exhibits a large difference between the maximum and minimum values of density data, the check pattern can be determined to be the best check pattern when density data changes slowly as a whole.

In this embodiment, amplitude difference values $C_j$ are detected from all regions of each check pattern. Accordingly, the state of variation in amplitude difference value $C_j$ as a whole can be grasped, so that the state of variation of density data as a whole can be grasped.

The maximum amplitude difference which is the maximum of the amplitude difference values $C_j$ exhibits a value which is proportional to the maximum (maximum variation value) of variation values of density data in each check pattern and which is proportional to the largest amount of displacement in record position (largest record position displacement amount) in the check pattern. For this reason, when the check pattern in which the maximum amplitude difference is the smallest is determined., the check pattern exhibiting the smallest displacement in record position can be extracted from all the check patterns.

According to this embodiment, the state of variation of density data as a whole can be grasped, and the check pattern exhibiting the smallest displacement in record position can be extracted. Accordingly, even in the case where density data of the check pattern changes slowly as a whole, the check pattern can be determined to be the best check pattern. A result of determination close to the human sense can be obtained.

In this embodiment, the ink jet printer 4 is equivalent to a recording apparatus described in the scope of claims. The recording head 23P is equivalent to a recording head. The recording mechanism section 10 is equivalent to recording section. The step S160 in the reciprocating record position automatic alignment control process is equivalent to check pattern recording section. The medium sensor 27 is equivalent to a sensor. The steps S170, S180 and S190 are equivalent to density data detection section.

The gradation data (analog data) or AD values (digital data) are equivalent to density data. The steps S510 to S620 in the determination data computing process are equivalent to density amplitude detection section. The step S630 is equivalent to amplitude difference detection section. The step S640 in the determination data computing process and the step S350 in the best check pattern number N computing process are equivalent to best check pattern determination section. The steps S250 and S280 in the reciprocating record position automatic alignment control process are equivalent to record position setting section.

The reciprocating record position alignment method using the reciprocating record position automatic alignment control process is equivalent to a reciprocating record position alignment method in the scope of claims. The step S160 in the reciprocating record position automatic alignment control process is equivalent to a first step. The steps S170, S180 and S190 in the reciprocating record position automatic alignment control process are equivalent to a second step. The steps S510 to S620 in the determination data computing process are equivalent to a third step. The step S630 in the determination data computing process is equivalent to a fourth step. The step S640 in the determination data computing process and the step S350 in the best check pattern number N computing process is equivalent to a fifth step. The steps S250 and S280 in the reciprocating record position automatic alignment control process are equivalent to a sixth step.

Although an embodiment of the invention has been described below, the invention is not limited to the embodiment and various modifications may be made.

Although the aforementioned embodiment (hereinafter referred to as first embodiment) has shown the case where the maximum (maximum amplitude difference value) of all amplitude difference values $C_j$ is set as determination data in S640 in the determination data computing process, the numerical value set as determination data is not limited to the maximum amplitude difference value.

For example, the average (overall average amplitude difference value) of all amplitude difference values $C_j$ may be used in place of the maximum amplitude difference value so as to be set as determination data. In this case, the check pattern exhibiting the smallest determination data in all the check patterns is determined to be the best check pattern on the basis of the overall average amplitude difference values set as the determination data (second embodiment).

Even in the case where density data varies according to the influence of noise or the like, the overall average amplitude difference value little changes compared with the overall average amplitude difference value in the case where there is no noise or the like if the degree of variation of density data is small. That is, a check pattern in which density data changes slowly as a whole exhibits a small overall average amplitude difference value when the influence of noise or the like is small.

When the check pattern in which density data changes slowly as a whole and little varies according to the influence of noise or the like is determined by human eye observation, a decision can be made that there is no displacement in record position. For this reason, when a plurality of check patterns are determined on the basis of the overall average amplitude difference values, a result of determination close to a result of determination by human eye observation can be obtained in the determination of the best check pattern in which displacement in record position is the smallest.

If the degree of variation of density data in accordance with the influence of noise or the like is large, the amplitude difference values $C_j$ are large as a whole compared with the case where there is no noise or the like, so that the check pattern intensively affected by noise or the like exhibits a large overall average amplitude difference value.

When the check pattern in which density data varies widely according to the influence of noise or the like is determined by human eye observation, a decision can be made that there is any displacement in record position. For this reason, when the check pattern exhibiting the smallest determination data as the overall average amplitude difference value is determined to be the best check pattern, it is possible to avoid a misjudgment that a defective check pattern exhibiting any displacement in record position is determined to be the best check pattern.

Accordingly, in the second embodiment in which a determination is made on the basis of the overall average amplitude difference values, the best check pattern can be decided while the influence of noise or the like suddenly generated is suppressed. Moreover, a defective check pattern intensively affected by noise or the like can be prevented from being mis-determined to be best check pattern. A result of determination close to the human sense can be obtained.

The average of minimum ascending order amplitude difference values of amplitude difference values $C_j$ may be used in place of the maximum amplitude difference value or the overall average amplitude difference value so as to be set as determination data. The average of minimum ascending order amplitude difference values of amplitude difference values $C_j$ is calculated as follows. That is, all amplitude difference values $C_j$ are arranged in ascending order. Amplitude difference values $C_j$ of the number to be detected are extracted in ascending order from the amplitude difference values $C_j$ arranged in ascending order with the minimum as a start point. The average of the extracted amplitude difference values $C_j$ of the number to be detected is set as determination data in each check pattern.

A check pattern exhibiting the smallest determination data in all the check patterns is determined to be the best check pattern on the basis of the average of minimum ascending order amplitude difference values set as determination data (third embodiment).

When density data varies according to the influence of noise or the like, the amplitude difference value $C_j$ in a portion exhibiting the variation of density data is large. Accordingly, there is a very low possibility that the amplitude difference value affected by noise or the like will be included in the amplitude difference values $C_j$ which are of the number to be detected and which are extracted in ascending order from all the amplitude difference values $C_j$ arranged in ascending order.

For this reason, even in the case where density data varies according to the influence of noise or the like, the average of minimum ascending order amplitude difference values little changes compared with the average of minimum ascending order amplitude difference values in the case where there is no noise or the like. That is, in a check pattern in which density data changes slowly as a whole, the average of minimum ascending order amplitude difference values is provided as a small value if the frequency of generation of noise or the like is low even in the case where density data varies according to the influence of noise or the like.

When the check pattern in which density data changes slowly as a whole and in which the frequency of generation of noise or the like is low is determined by human eye observation, a decision can be made that there is no displacement in record position. Accordingly, when the check pattern exhibiting the smallest determination data (the smallest average of minimum ascending order amplitude difference values) in all the check patterns is determined to be the best check pattern on the basis of the average of minimum ascending order amplitude difference values, a result of determination close to the human sense can be obtained.

When the frequency of generation of variation of density data in accordance with the influence of noise or the like is high, the rate of large amplitude difference values to all amplitude difference values is high compared with the case where there is no variation of density data in accordance with noise or the like. Accordingly, in a check pattern intensively affected by noise or the like, the average of minimum ascending order amplitude difference values is provided as a large value.

When the check pattern in which density data varies widely according to the influence of noise or the like is determined by human eye observation, a decision can be made that there is any displacement in record position. For this reason, when the check pattern exhibiting the smallest determination data based on the overall average amplitude difference value is determined to be the best check pattern, it is possible to avoid a misjudgment that a defective check pattern in which there is any displacement in record position may be determined to be the best check pattern.

Accordingly, when a determination is made on the basis of the average of minimum ascending order amplitude difference values, a check pattern which is uniform as a whole but has a partial portion where density data varies according to the influence of noise or the like can be determined to be the best check pattern while the influence of the partial portion is suppressed. When a determination is made in this manner, a defective check pattern intensively affected by noise or the like can be prevented from being mis-determined to be the best check pattern. A result of determination close to the human sense can be obtained.

Figure 15:
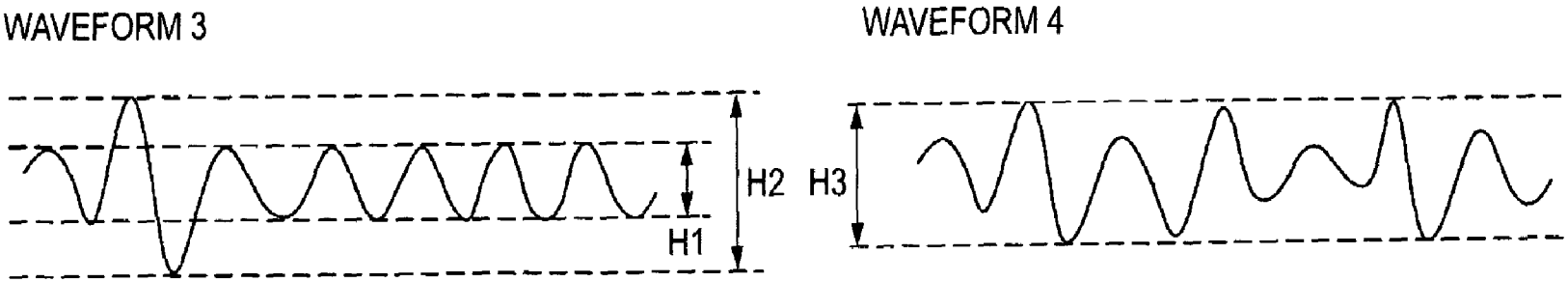
FIG. 15 is an explanatory view showing a density data waveform (waveform 3) of a check pattern in which the difference H2 in a part affected by noise is large but the difference H1 in the other part than the part affected by noise is smaller than the difference H2, and a density data waveform (waveform 4) of a check pattern in which the difference H3 is smaller than the difference H2 in the waveform 3 but density data changes irregularly.

FIG. 15 shows a density data waveform (waveform 3) in a check pattern in which density data changes slowly so that a partial portion affected by noise exhibits a large difference H2 between the maximum and minimum values of density data (AD values) but other portions than the portion affected by noise exhibit a difference H1 smaller than the difference H2, and a density data waveform (waveform 4) in a check pattern in which density data changes irregularly though the difference H3 between the maximum and minimum values of density data is smaller than the difference H2 in the waveform 3.

To compare the waveforms 3 and 4 with each other, the waveforms 3 and 4 are determined by human eye observation as follows. That is, when the waveform 3 is determined by human eye observation, a decision can be made that there is no displacement in record position because density data is partially affected by noise but changes slowly as a whole. On the other hand, when the waveform 4 is determined by human eye observation, a decision can be made that there is any displacement in record position because density data changes so irregularly that record irregularity is sensible.

When the waveforms 3 and 4 are determined as to whether there is any displacement in record position or not, by a determination method in which amplitude difference values $C_j$ are detected from density data in each check pattern and in which the average of minimum ascending order amplitude difference values of the amplitude difference values $C_j$ is set as determination data in each check pattern, the average of minimum ascending order amplitude difference values in the waveform 3 is so small that a small value is set as the determination data whereas the average of minimum ascending order amplitude difference values in the waveform 4 is so large that a large value is set as the determination data.

For this reason, the waveform 4 in which the determination data (the average of minimum ascending order amplitude difference values) is large can be given a determination that there is any displacement in record position because the amount of variation in AD value is large whereas the waveform 3 in which the determination data (the average of minimum ascending order amplitude difference values) is small can be given a determination that there is no displacement in record position because the amount of variation in AD value is small.

When the determination data (the average of minimum ascending order amplitude difference values) in the check pattern of the waveform 3 is the smallest in those in all the check patterns, the check pattern of the waveform 3 is determined to be the best check pattern.

Accordingly, in the determination method in which amplitude difference values $C_j$ are detected from density data in each check pattern and in which the average of minimum ascending order amplitude difference values of the amplitude difference values $C_j$ is set as determination data in each check pattern, a result of determination as to whether there is any displacement in record position or not, can be obtained as a result of determination close to a result of determination by human eye observation.

Although the aforementioned three embodiments have shown the case where amplitude difference values $C_j$ are detected from density data (AD values (digital data)) in the whole region ranging from one end portion to the other portion of each check pattern, the invention may be applied to the case where amplitude difference values $C_j$ are detected from density data in a partial region of each check pattern.

For example, in any one of the aforementioned embodiments, the determination data computing process may be modified so that amplitude difference values $C_j$ are detected at three places, namely, one end portion, a central portion and the other end portion of each check pattern in the reciprocating direction of the recoding head 23P (fourth embodiment).

Specifically, the steps S510 to S620 in the determination data computing process are modified so that amplitude values $A_i$ (density amplitude values $B_i$) of two partial data adjacent to each other are detected at each of the three places (one end portion, a central portion and the other portion) of each check pattern, that is, six density amplitude values $B_i$ in total are detected.

The step S630 is modified so that an amplitude difference value $C_j$ is calculated in accordance with each of the three places (one end portion, a central portion and the other end portion), that is, three amplitude difference values $C_j$ in total are calculated. The step S640 is modified so that the average of the three amplitude difference values $C_j$ (partial average amplitude difference value) is set as determination data.

When amplitude difference values $C_j$ are detected from a limited partial region of each check pattern in this manner, the quantity of detected data can be reduced compared with the case where amplitude difference values $C_j$ are detected from the whole region of each check pattern. Accordingly, the load imposed on the detecting process in the apparatus can be lightened, so that throughput speed can be improved.

Because the three places, namely, one end portion, a central portion and the other end portion of each check pattern in the reciprocating direction of the recording head 23P are disposed so as to be far from one another, the use of the amplitude difference values $C_j$ obtained at the three places has an advantage that the overall tendency of variation of density data in each check pattern can be grasped.

Accordingly, when a determination is made on the basis of the amplitude difference values $C_j$ obtained at the three places (one end portion, a central portion and the other end portion) of each check pattern, amplitude difference values can be extracted from places in which the overall tendency of variation of density data in each check pattern can be reflected easily. When the best check pattern is decided, a result of determination close to a result of determination by the human sense can be obtained while reduction in load imposed on the detecting process and improvement in throughput speed can be attained.

Although the aforementioned embodiments have shown the case where the partial detection pitch (K/2) is set to be shorter than the width (pattern pitch K) of each partial determination segment, the invention may be applied to the case where the partial detection pitch is set to be equal to or larger than the width of each partial determination segment.

The forward recording ruled line data and the backward recording ruled line data are not limited to those shown in FIGS. 7A and 7B. Various data provided so that displacement in record position can be corrected can be used as the forward recording ruled line data and the backward recording ruled line data.

Moreover, the best check pattern and the amount of displacement may be recorded with a color such as red so that they can be discriminated easily at a glance.

Figure 4:
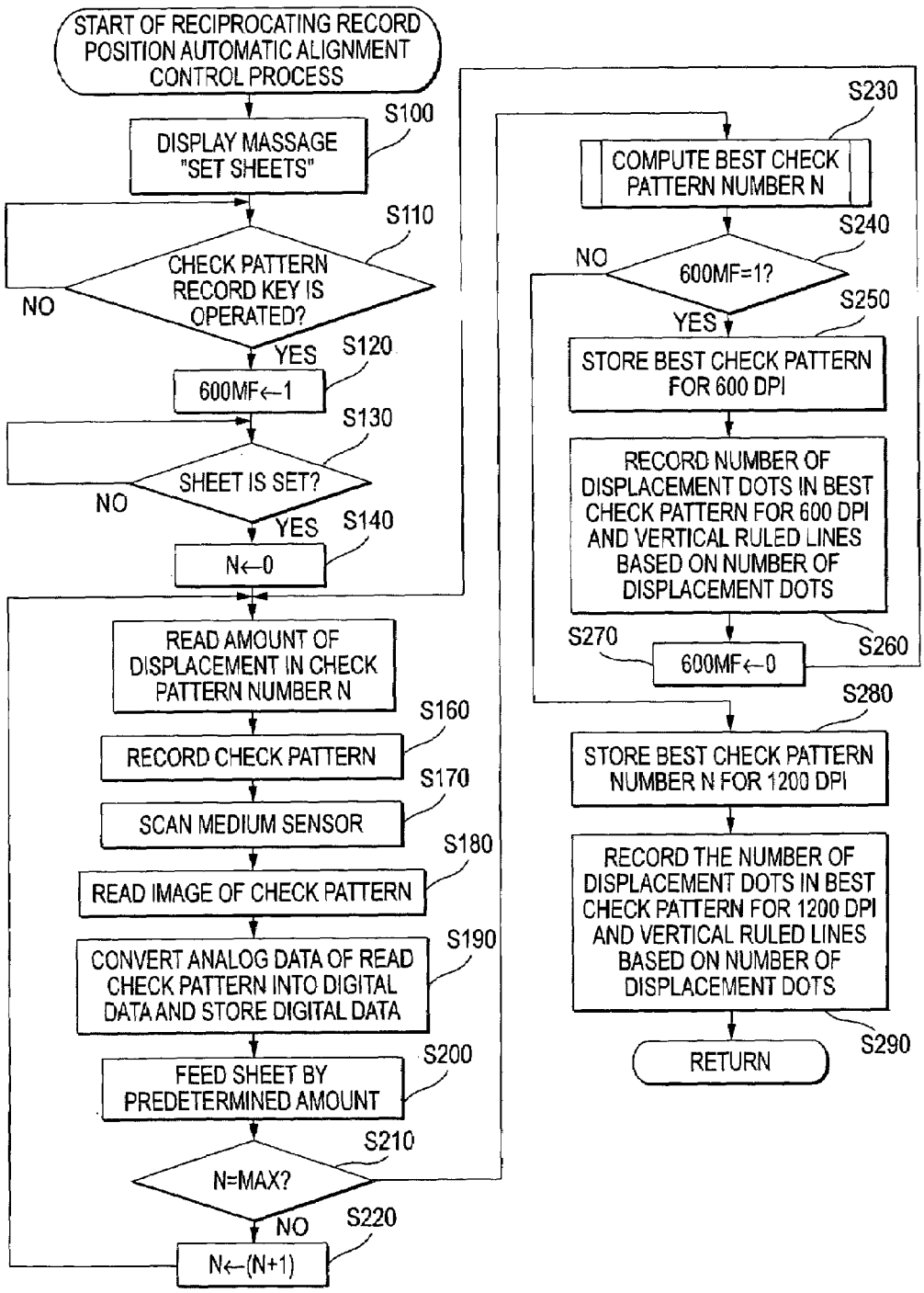
FIG. 4 is a flow chart showing the contents of a reciprocating record position automatic alignment control process.
Figure 5:
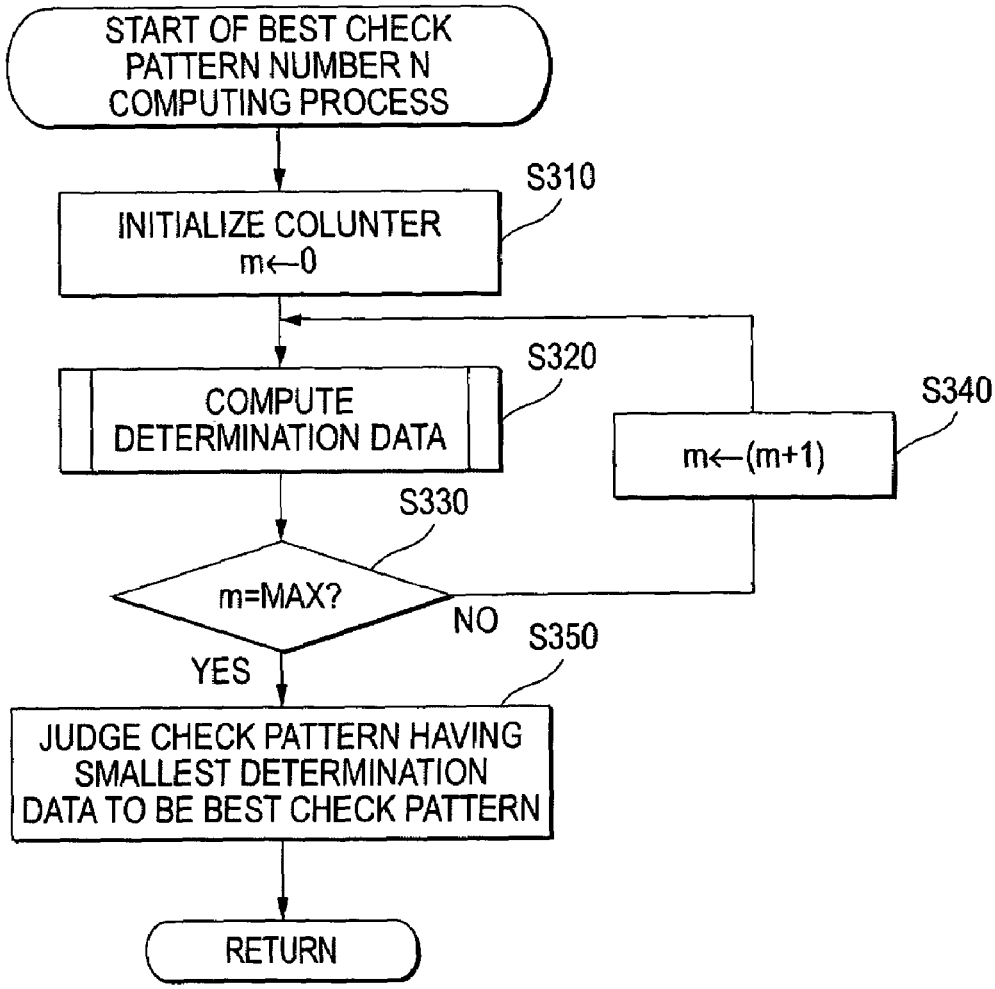
FIG. 5 is a flow chart showing the contents of an arithmetic process for detecting the best check pattern number N.

The reciprocating record position automatic alignment control shown in FIG. 4 may be executed automatically whenever the recording head 23P is exchanged.

In addition, the determination data is not limited to the aforementioned data such as the average of amplitude difference values. An index (such as a standard deviation, etc.) showing the tendency of variation in amplitude difference value may be set as the determination data. In this case, the check pattern in which the amount of variation in amplitude difference value is the smallest is determined to be the best check pattern on the basis of the determination data.

In the recording apparatus, the amplitude difference detection section detects a plurality of the amplitude difference values in the whole region of each of the check patterns, and the best pattern determination section extracts a maximum of the amplitude difference values as a maximum amplitude difference value in each of the check patterns and judges a check pattern in which the maximum amplitude difference value is the smallest in each of the check patterns as the best check pattern.

In the reciprocating record position alignment method, the fourth step detects a plurality of the amplitude difference values in the whole region of each of the check patterns, and the fifth step extracts a maximum of the amplitude difference values as a maximum amplitude difference value in each of the check patterns and judges a check pattern in which the maximum amplitude difference value is the smallest in each of the check patterns as the best check pattern.

As described above, when the amplitude difference values ate detected in the whole region of each check pattern, the state of variation in amplitude difference value as a whole can be grasped and the state of variation of density data as a whole can be grasped.

The maximum amplitude difference value which is the maximum of the amplitude difference values exhibits a value which is proportional to the maximum of density data variation values (maximum variation value) in the check pattern and which is proportional to the largest amount of displacement in record position (largest record position displacement amount) in the check pattern.

For this reason, when the maximum amplitude difference values in a plurality of check patterns are compared with one another to determine the check pattern exhibiting the smallest maximum amplitude difference value, the check pattern exhibiting the smallest amount of displacement in record position can be extracted.

Therefore, because the state of variation of density data as a whole can be grasped and the check pattern exhibiting the smallest amount of displacement in record position can be extracted, even a check pattern in which density data changes slowly as a whole can be determined to be the best check pattern. A result of judgment close to the human sense can be obtained.

In the recording apparatus, the amplitude difference detection section detects a plurality of the amplitude difference values in a partial region of each of the check patterns, and the best pattern determination section extracts an average of the amplitude difference values as a partial average amplitude difference value in each of the check patterns and judges a check pattern in which the partial average amplitude difference value is the smallest in each of the check patterns as the best check pattern.

In the reciprocating record position alignment method, the fourth step detects a plurality of the amplitude difference values in a partial region of each of the check patterns, and the fifth step extracts an average of the amplitude difference values as a partial average amplitude difference value in each of the check patterns and judges a check pattern in which the partial average amplitude difference value is the smallest in each of the check patterns as the best check pattern.

As described above, when the amplitude difference values are detected in a limited partial region of each check pattern, the quantity of detected data can be reduced compared with the case where the amplitude difference values are detected in the whole region of each check pattern. Accordingly, the load imposed on the detecting process in the apparatus can be lightened, so that throughput speed can be improved.

When the partial region as a subject of detection of the amplitude difference values is set in another place than the place easily affected by noise, the amplitude difference values can be detected while the influence of noise is suppressed. Accordingly, improvement in accuracy of determination can be attained.

Otherwise, when the partial region as a subject of detection of the amplitude difference values is set at a place where the tendency of variation of density data as a whole in each check pattern is reflected easily, the tendency of variation of density data as a whole can be extracted so that accuracy of judgment can be prevented from being lowered.

When the partial region as a subject of detection of the amplitude difference values is set at a place where displacement in record position in each check pattern occurs easily, accuracy of detection of displacement in record position can be improved so that improvement in accuracy of alignment in record position (printing portion) can be attained.

In the recording apparatus, the amplitude difference detection section detects the amplitude difference values one end portion, a central portion and the other end portion of each of the check patterns in the reciprocating direction of the recording head.

In the reciprocating record position alignment method, the fourth step detects the amplitude difference values at one end portion, a central portion and the other end portion of each of the check patterns in the reciprocating direction of the recording head.

As described above, because the three portions, namely, one end portion, a central portion and the other end portion of each check pattern are disposed so as to be far from one another, the tendency of variation of density data in each check pattern as a whole can be grasped when the amplitude difference values measured at the three portions are used.

Therefore, the amplitude difference values can be extracted from places where the tendency of variation of density data as a whole in each check pattern is reflected easily. When the best check pattern is determined, a result of determination close to a result of determination by human sense can be obtained while both reduction in load imposed on the detecting process and improvement in throughput speed can be attained.

In the recording apparatus, the amplitude difference detection section detects a plurality of the amplitude difference values in the whole region of each of the check patterns, and the best check pattern determination section extracts an average of the amplitude difference values as an overall average amplitude difference value in each of the check patterns and judges a check pattern in which the overall average amplitude difference value is the smallest in each of the check patterns as the best check pattern.

In the reciprocating record position alignment method, the fourth step detects a plurality of the amplitude difference values in the whole region of each of the check patterns, and the fifth step extracts an average of the amplitude difference values as an overall average amplitude difference value in each of the check patterns and judges a check pattern in which the overall average amplitude difference value is the smallest in each of the check patterns as the best check pattern.

As described above, when the amplitude difference values are detected in the whole region of each check pattern, the state of variation in amplitude difference value as a whole can be grasped and the state of variation of density data as a whole can be grasped.

Even in the case where density data varies according to the influence of noise or the like, the average of the amplitude difference values in the whole region of each check pattern (overall average amplitude difference value) is prevented from becoming considerably large compared with the overall average amplitude value in the case where there is no noise or the like, if the degree of variation of density data is small. That is, when the influence of noise or the like on a check pattern in which density data changes slowly as a whole is small, the overall average amplitude difference value in the check pattern exhibits a small value.

When the check pattern in which density data changes slowly as a whole and in which the degree of variation of density data according to the influence of noise or the like is small is determined by human eye observation, a decision can be made that there is no displacement in record position. For this reason, when the best check pattern exhibiting the smallest displacement in record position is determined on the basis of the overall average amplitude difference values of a plurality of check patterns, a result of determination close to a result of determination by human sense can be obtained.

When the degree of variation of density data according to the influence of noise or the like is large, the check pattern intensively affected by noise or the like exhibits a large overall average amplitude difference value because the amplitude difference values are large as a whole compared with the case where there is no noise or the like.

When the check pattern in which density data varies widely according to the influence of noise or the like is determined by human eye observation, a decision can be made that there is any displacement in record position. For this reason, when a determination is made on the basis of the overall average amplitude difference values in a plurality of check patterns, it is possible to avoid a misjudgment that a defective check pattern in which there is any displacement in record position is determined to be the best check pattern. A result of determination close to the human sense can be obtained.

Therefore, the best check pattern can be determined while the influence of noise or the like generated suddenly is suppressed. Moreover, a defective check pattern intensively affected by noise or the like can be prevented from being determined to be the best check pattern. A result of determination close to the human sense can be obtained.

In the recording apparatus, the amplitude difference detection section detects a plurality of the amplitude difference values in the whole region of each of the check patterns, and the best pattern determination section arranges the amplitude difference values in ascending order in each of the check patterns, extracts the ascending amplitude difference values including a minimum amplitude difference value, detects an average of the extracted amplitude difference values as a minimum ascending average amplitude difference values in each check pattern, and judges a check pattern in which the minimum ascending average amplitude difference value is the smallest in each of the check patterns as the best check pattern.

In the reciprocating record position alignment method, the fourth step detects a plurality of the amplitude difference values in the whole region of each of the check patterns, and the fifth step arranges the amplitude difference values in ascending order in each of the check patterns, extracts the ascending amplitude difference values including a minimum amplitude difference value, detects an average of the extracted amplitude difference values as a minimum ascending average amplitude difference values in each check pattern, and judges a check pattern in which the minimum ascending amplitude difference value is the smallest in each of the check patterns as the best check pattern.

As described above, when the amplitude difference values are detected in the whole region of each check pattern, the state of variation in amplitude difference value as a whole can be grasped and the state of variation of density data as a whole can be grasped.

When density data varies according to the influence of noise or the like, a portion in which the variation of density data is generated exhibits a large amplitude difference value. Accordingly, there is a very low possibility that an amplitude difference value affected by noise or the like will be contained in amplitude difference values which are of the number to be detected and which are extracted with the minimum as a start point from the amplitude difference values arranged in ascending order.

For this reason, even in the case where density data varies according to the influence of noise or the like, the average of the amplitude difference values (the average of minimum ascending order amplitude difference values) which are of the number to be detected and which are extracted with the minimum as a start point from the amplitude difference values arranged in ascending order does not change widely compared with the average of minimum ascending order amplitude difference values in the case where there is no noise or the like. That is, even in the case where density data varies according to the influence of noise or the like, the average of minimum ascending order amplitude difference values in a check pattern in which density data changes slowly as a whole exhibits a small value if the frequency of generation of noise or the like is low.

When the check pattern in which density data changes slowly as a whole and in which the frequency of generation of noise or the like is low is determined by human eye observation, a decision can be made that there is no displacement in record position. Accordingly, when the best check pattern exhibiting the smallest displacement in record position is determined on the basis of the averages of minimum ascending order amplitude difference values in a plurality of check patterns, a result of determination close to the human sense can be obtained.

When the frequency of generation of variation of density data according to the influence of noise or the like is high, the rate of large amplitude difference values to all the amplitude difference values increases compared with the case where there is no variation of density data according to noise or the like. The average of minimum ascending order amplitude difference values in a check pattern intensively affected by noise or the like exhibits a large value.

When the check pattern in which density data varies widely according to the influence of noise or the like is determined by human eye observation, a decision can be made that there is any displacement in record position. Accordingly, when a determination is made on the basis of the averages of minimum ascending order amplitude difference values in a plurality of check patterns, it is possible to avoid a misjudgment that a defective check pattern in which there is any displacement in record position is determined to be the best check pattern. A result of determination close to the human sense can be obtained.

Therefore, even a check pattern which is uniform as a whole but has a variation portion affected by noise or the like can be determined to be the best check pattern while the influence of the variation portion is suppressed. Moreover, a defective check pattern intensively affected by noise or the like can be prevented from being mis-determined to be the best check pattern. A result of determination close to the human sense can be obtained.

What is claimed is:

1. A recording apparatus comprising:

a recording section that reciprocates a recording head having a plurality of ink jet nozzles through a carriage to perform bidirectional recording in which forward record and backward record by the recording head are superposed on a recording medium;

a check pattern recording section that forms a plurality of check patterns which are different in record position of backward recording relative to forward recording on the recording medium when each check pattern having a plurality of vertical ruled lines is recorded by performing the bidirectional recording with the recording section;

a sensor that moves in parallel with a moving direction of the carriage, the sensor including a light-emitting section that emits light toward the recording medium, and a light-receiving section that receives light reflected from the recording medium;

a density data detection section that acquires density data indicating degree of light and shade of each check pattern based on the reflected light received by the light-receiving section when the sensor is moved from one end portion to the other end portion of each check pattern;

a density amplitude detection section that extracts a plurality of partial data contained in each predetermined partial determination segment from the density data acquired with respect to each of the check patterns, detects a minimum value and a maximum value of the partial data in the partial determination segment, and detects a difference between the minimum value and the maximum value of the partial data as a density amplitude value;

an amplitude difference detection section that detects a difference between the density amplitude values of adjacent partial determination segments as an amplitude difference value in each check pattern;

a best pattern determination section that judges the amount of variation of the density data in each check pattern based on the amplitude difference values detected by the amplitude difference detection section to determine a check pattern in which the amount of variation of the density data is the smallest in the check patterns as a best check pattern in each check pattern; and a record position setting section that sets record positions of forward recording and backward recording of a check pattern determined to be the best check pattern by the best check pattern determination section as record positions when recording is performed.

2. The recording apparatus according to claim 1, wherein the amplitude difference detection section detects a plurality of the amplitude difference values in the whole region of each of the check patterns, and the best pattern determination section extracts a maximum of the amplitude difference values as a maximum amplitude difference value in each of the check patterns and judges a check pattern in which the maximum amplitude difference value is the smallest in each of the check patterns as the best check pattern.

3. The recording apparatus according to claim 1, wherein the amplitude difference detection section detects a plurality of the amplitude difference values in a partial region of each of the check patterns, and the best pattern determination section extracts an average of the amplitude difference values as a partial average amplitude difference value in each of the check patterns and judges a check pattern in which the partial average amplitude difference value is the smallest in each of the check patterns as the best check pattern.

4. The recording apparatus according to claim 3, wherein the amplitude difference detection section detects the amplitude difference values at one end portion, a central portion and the other end portion of each of the check patterns in the reciprocating direction of the recording head.

5. The recording apparatus according to claim 1, wherein the amplitude difference detection section detects a plurality of the amplitude difference values in the whole region of each of the check patterns, and the best pattern determination section extracts an average of the amplitude difference values as an overall average amplitude difference value in each of the check patterns and judges a check pattern in which the overall average amplitude difference value is the smallest in each of the check patterns as the best check pattern.

6. The recording apparatus according to claim 1, wherein the amplitude difference detection section detects a plurality of the amplitude difference values in the whole region of each of the check patterns, and the best pattern determination section arranges the amplitude difference values in ascending order in each of the check patterns, extracts the ascending amplitude difference values including a minimum amplitude difference value, detects an average of the extracted amplitude difference values as a minimum ascending average amplitude difference values in each check pattern, and judges a check pattern in which the minimum ascending average amplitude difference value is the smallest in each of the check patterns as the best check pattern.

7. A reciprocating record position alignment method of aligning record position of backward recording relative to forward recording in a recording apparatus for reciprocating a recording head having a plurality of ink jet nozzles through a carriage to perform bidirectional recording in which forward record and backward record by the recording head are superposed on a recording medium, the method comprising:

a first step of recording a plurality of check patterns which are different in record position of the backward recording relative to the forward recording when each check pattern having a plurality of vertical ruled lines is recorded by performing the bidirectional recording;

a second step of applying light on a region ranging one end portion to the other end portion of each check pattern in the reciprocating direction of the recording head and receiving light reflected from the check pattern to acquire density data indicating degree of light and shade of each check pattern based on the reflected light;

a third step of extracting a plurality of partial data contained in each predetermined partial determination segment from the density data acquired with respect to each check of the check patterns, detecting a minimum value and a maximum value of the partial-data in the partial determination segment, and detecting a difference between the minimum value and the maximum value of the partial data as a density amplitude value;

a fourth step of detecting a difference between the density amplitude values of adjacent partial determination segments as an amplitude difference value in each check pattern;

a fifth step of judging the amount of variation of the density data in each check pattern based on the amplitude difference values detected by the fourth step to determine a check pattern in which the amount of variation of the density data is the smallest in the check patterns as a best check pattern in each check pattern; and a sixth step of setting the record position of backward recording relative to forward recording in a check pattern determined to be the best check pattern by the fifth step as record position when recording is performed.

8. The reciprocating record position alignment method according to claim 7, wherein the fourth step detects a plurality of the amplitude difference values in the whole region of each of the check patterns, and the fifth step extracts a maximum of the amplitude difference values as a maximum amplitude difference value in each of the check patterns and judges a check pattern in which the maximum amplitude difference value is the smallest in each of the check patterns as the best check pattern.

9. The reciprocating record position alignment method according to claim 7, wherein the fourth step detects a plurality of the amplitude difference values in a partial region of each of the check patterns, and the fifth step extracts an average of the amplitude difference values as a partial average amplitude difference value in each of the check patterns and judges a check pattern in which the partial average amplitude difference value is the smallest in each of the check patterns as the best check pattern.

10. The reciprocating record position alignment method according to claim 9, wherein the fourth step detects the amplitude difference values at one end portion, a central portion and the other end portion of each of the check patterns in the reciprocating direction of the recording head.

11. The reciprocating record position alignment method according to claim 7, wherein the fourth step detects a plurality of the amplitude difference values in the whole region of each of the check patterns, and the fifth step extracts an average of the amplitude difference values as an overall average amplitude difference value in each of the check patterns and judges a check pattern in which the overall average amplitude difference value is the smallest in each of the check patterns as the best check pattern.

12. The reciprocating record position alignment method according to claim 7, wherein the fourth step detects a plurality of the amplitude difference values in the whole region of each of the check patterns, and the fifth step arranges the amplitude difference values in ascending order in each of the check patterns, extracts the ascending amplitude difference values including a minimum amplitude difference value, detects an average of the extracted amplitude difference values as a minimum ascending average amplitude difference values in each check pattern, and judges a check pattern in which the minimum ascending amplitude difference value is the smallest in each of the check patterns as the best check pattern.

* * * * *